US006253043B1

(12) United States Patent
Isobe

(10) Patent No.: US 6,253,043 B1
(45) **Date of Patent: *Jun. 26, 2001**

(54) DEVELOPER SEALING MEMBER AND DEVELOPING APPARATUS PROVIDED WITH THE SAME

(75) Inventor: Hironobu Isobe, Numazu (JP)

(73) Assignee: Canon Kabushiki Kaisha, Tokyo (JP)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/372,996

(22) Filed: Aug. 12, 1999

(30) Foreign Application Priority Data

Aug. 31, 1998 (JP) ..... 10-262420

(51) Int. Cl.[7] ..... G03G 15/08
(52) U.S. Cl. ..... 399/103
(58) Field of Search ..... 399/103, 105, 399/106, 265, 279; 428/85, 91, 92

(56) References Cited

U.S. PATENT DOCUMENTS 4,707,108 11/1987 Ohno .
5,040,031 8/1991 Hayashi .
5,296,902 3/1994 Michlin .
5,488,462 * 1/1996 Ishikawa et al. .
5,592,268 * 1/1997 Uehara et al. .

FOREIGN PATENT DOCUMENTS 60-156078 * 8/1985 (JP) .
61-129664 * 6/1986 (JP) .
2-302770 * 12/1990 (JP) .
3-044688 * 2/1991 (JP) .
3-061970 * 3/1991 (JP) .

* cited by examiner

*Primary Examiner*—Robert Beatty
(74) *Attorney, Agent, or Firm*—Fitzpatrick, Cella, Harper & Scinto

(57) ABSTRACT

The present invention relates to a seal member contacted with a rotatable body for sealing a developer borne on the rotatable body which has a surface layer contacted with the rotatable body, wherein the seal member's surface layer includes felt. The surface layer has a first portion formed by a plurality of fibers being intertwined, and a second loop portion in which the fibers are raised in a loop shape.

21 Claims, 24 Drawing Sheets

FIG. 19A
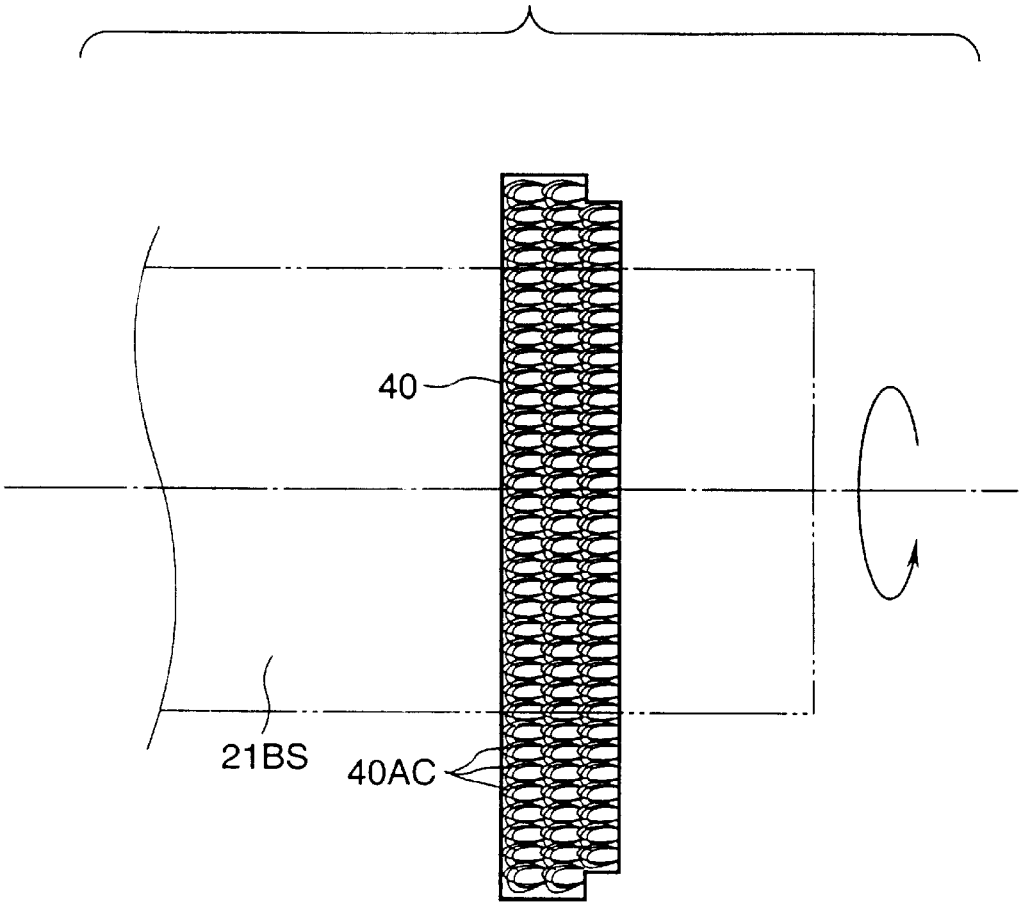
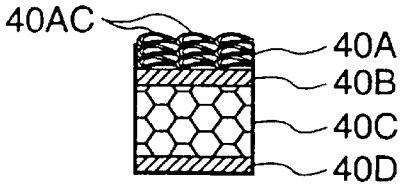
FIG. 19B

DEVELOPER SEALING MEMBER AND DEVELOPING APPARATUS PROVIDED WITH THE SAME

BACKGROUND OF THE INVENTION

1. Field of the Invention

This invention relates to a developing apparatus which can be used in an image forming apparatus such as an electrophotographic apparatus, and to a developer sealing member which can be used in the developing apparatus.

2. Related Background Art

An electrophotographic image forming apparatus, such as a printer, effects selective exposure on an image bearing body (photosensitive drum) uniformly charged by a charging device to thereby form a latent image, and visualizes the latent image with a developer (toner) by a developing device and transfers the image by the developer to a recording medium to thereby effect image recording. After the transfer, any developer remaining on the image bearing body is removed by a cleaning blade and the removed developer is stored in a cleaning container and the next development is effected by the image bearing body, the surface of which is clean.

In recent years, there has been put into practical use an apparatus in which the image bearing body, the charging device, the developing device, the cleaning portion, the waste toner box, etc. are collected into an integral structure and made into a cartridge, whereby a user loads the main body of the apparatus with the cartridge to enable the interchange of the parts of the developer image bearing body and thereby facilitate the maintenance thereof.

Further, when the life of the image bearing body extends and the number of printable sheets is increased, the developing device, which is otherwise limited in its supplying capability, is made into an independent unit. The apparatus is divided into the developing unit and a drum unit comprising the image bearing body, the charging device and the cleaning portion integral as image forming process means. Like the process cartridge, the mounting and maintenance of the main body of the apparatus are simplified, and the way of use conforming to the lives of the main parts has come to be adopted. In this drum unit, the waste toner produced by cleaning is stored in the cleaning container having a volume capable of being sufficiently contained in the life of the image bearing body, and is removed during the interchange of the drum unit.

In recent years, the demand for color electrophotographic image forming apparatuses capable of effecting the formation color images has been increasing. There is known, for example, a construction in which developing devices 105M, 105C, 105Y and 105K of four colors are all disposed in a rotary (for example, U.S. Pat. No. 4,707,108, U.S. Pat. No. 5,040,031, etc.).

Such a construction is very effective for forming colored images.

On the other hand, the future color electrophotographic image forming apparatus for copying with a network needs to cope with a large-quantity high-speed output irrespective of the propriety of the output of a color document. It is also desirable to reduce the cost per page to the level in a monochromatic electrophotograhic image forming apparatus.

To cope with such a desire, it is necessary to lengthen the lives of expendables used in this apparatus (such as the developing unit and the image bearing body unit which is the drum unit, or a process cartridge comprising the developing unit and the image bearing body unit constructed integrally with each other).

The developing unit is generally provided with developer sealing members on the opposite end portions of a developing roller.

The conventional developer sealing members, however, cannot sufficiently cope with the lengthening of the lives in some cases, and there has been a case where the developer (toner) leaks to the outside of the developer sealing members and contaminates the interior of the apparatus.

Also, in a situation in which the leakage of the developer occurs, the toner may adhere to a portion in which the developer sealing members are in close contact with a cylindrical member (such as the image bearing body or the developing roller (developing means)). Thus, there has arisen a case where the rotational torque of the cylindrical member becomes great and the load to the driving motor in the main body of the apparatus increases and stable operation cannot be accomplished.

SUMMARY OF THE INVENTION

The present invention is the further development of the above-described prior art and a main object thereof is to provide a developer sealing member which can improve a developer catching capability and can prevent the outflow of the developer.

Another main object of the present invention is to provide a developing apparatus provided with a developer sealing member which can improve the developer catching capability and can prevent the outflow of the developer.

BRIEF DESCRIPTION OF THE DRAWINGS

FIGS. 19A and 19B are illustrations of a toner sealing member in the embodiment.

DETAILED DESCRIPTION OF THE PREFERRED EMBODIMENTS

A color electrophotographic image forming apparatus according to the present invention will hereinafter be described with reference to the drawings.

Description of the Whole of the Image Forming Apparatus

The general construction of the color electrophotographic image forming apparatus will first be schematically described with reference to FIG. 1.

Figure 1:
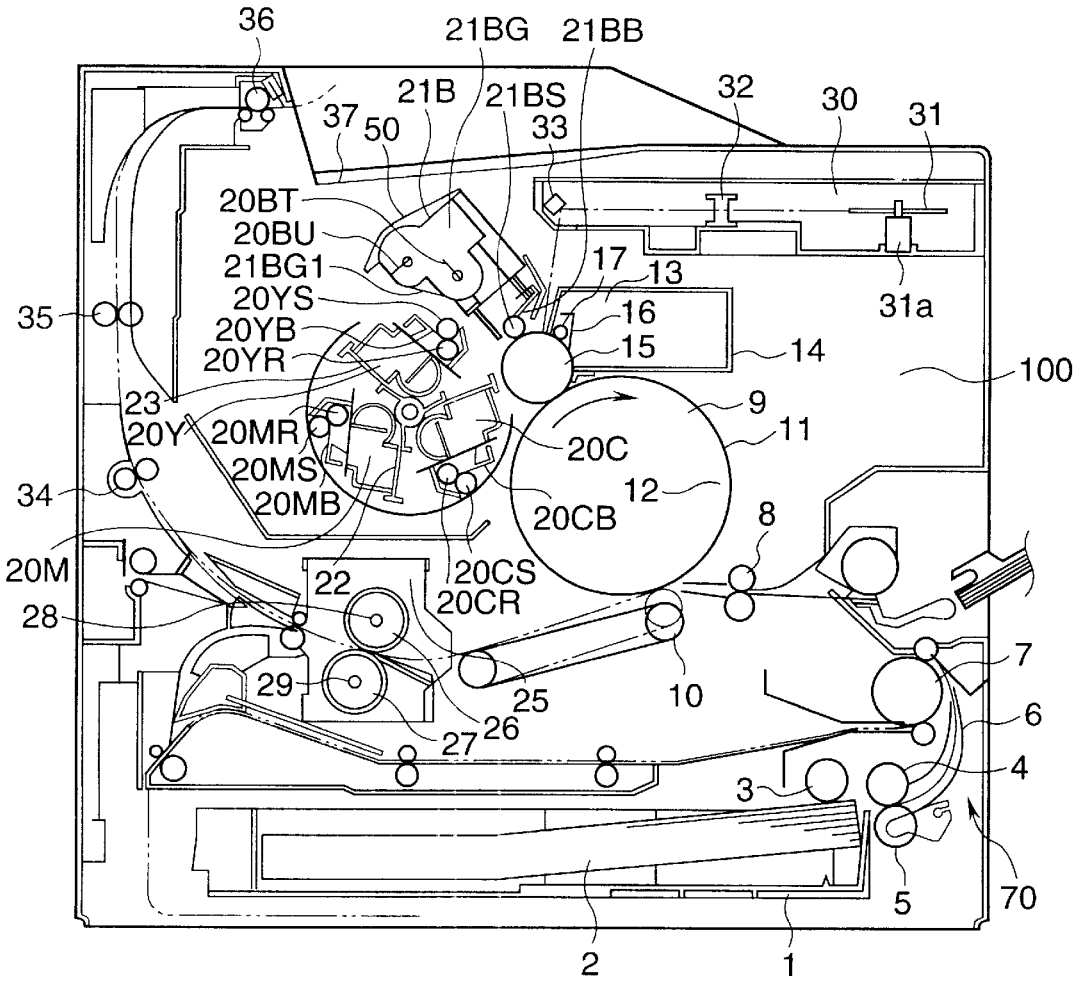
FIG. 1 is a cross-sectional view of a color laser printer according to an embodiment of the present invention.

FIG. 1 is an illustration of the general construction of a laser beam printer which is a form of the color toner image forming apparatus.

The image forming portion of the color laser beam printer is provided with an image bearing body (photosensitive drum (cylinder member)) 15 as an electrophotographic photosensitive body rotatable at a constant speed, a fixed type black developing unit 21B and three rotatable color developing units (a yellow developing unit 20Y, a magenta developing unit 20M and a cyan developing unit 20C).

Below the image forming portion, there is disposed an intermediate transfer body 9 holding a developed and multiplexly transferred color toner image thereon and further transferring it to a recording medium 2 fed from a feeding portion.

The recording medium 2 to which the color toner image has been transferred is conveyed to a fixing portion 25, whereby the color toner image is fixed on the recording medium 2, which is then discharged to a discharging portion 37 on the upper surface of the apparatus by discharge rollers 34, 35 and 36. The recording medium is, for example, a sheet of paper or an overhead projector sheet or the like.

The rotatable color developing units 20Y, 20M, 20C and the fixed type black developing units 21B are individually detachably attachable to the main body 100 of the printer (i.e., the main body of the image forming apparatus). Also, a sheet feeding roller 3, a feeding roller 4, a double feeding preventing retard roller 5, a feeding guide 6, a conveying roller 7, registration rollers 8 and discharge rollers 34, 35, 36 together constitute conveying means 70.

The construction of each portion of the image forming apparatus will now be described in detail.

Image Bearing Body Unit

A drum unit 13 as a process cartridge is such that the image bearing body 15, a cleaning device provided with a cleaning member (cleaning blade) 16, a charging device provided with a charging member (charging means) 17, and the cleaner container 14 of the cleaning device serving also as a holder for the image bearing body 15 are constructed integrally with one another. This drum unit 13 is horizontally inserted into a unit containing portion through a mounting port, not shown, provided in the main body 100 of the printer, and is made detachably attachable to a mounting guide (not shown) as mounting means provided in the unit containing portion. Accordingly, the drum unit 13 can be easily detached with respect to the main body 100 of the printer by a user, and is interchanged when the image bearing body 15 has reached the end of its life.

The image bearing body 15 according to the present embodiment is such that an organic photoconductive material layer is applied to the outer side of the aluminum cylinder, which has a diameter of about 62 mm. It is rotatably supported on the container 14 of the cleaning device serving also as the holder for the image bearing body 15.

The cleaner blade 16 as the cleaning member and the primary charging means 17 as the charging member are disposed along the peripheral surface of the image bearing body 15.

Also, a driving motor, not shown, is disposed on one rear end of the image bearing body 15. By the driving force of this motor being transmitted, the image bearing body 15 is rotated counter-clockwise in conformity with the image forming operation.

The cleaner blade 16 abuts against the image bearing body 15, and removes any toner remaining on the surface of the image bearing body 15 after the toner image has been transferred.

Charging Means

The charging means 17 uses a contact charging method. A charging roller, e.g. an electrically conductive roller, as the charging member, is made to abut against the image bearing body 15.

By applying a voltage to this charging roller, the surface of the image bearing body 15 is uniformly charged.

Exposure Means

The exposure to the image bearing body 15 is effected from a laser scanner portion 30. That is, when an image signal is given to a laser diode (not shown), this laser diode applies a light 18 corresponding to the image signal to a polygon mirror 31.

This polygon mirror 31 is rotated at a high speed by a scanner motor 31*a*, and the light 18 reflected by the polygon mirror 31 selectively exposes the surface of the image bearing body 15 rotated at a constant speed via an imaging lens 32 and a reflecting mirror 33. As a result, an electrostatic latent image conformity to image information is formed on the image bearing body 15.

Developing Mechanism

The developing mechanism of the present embodiment is provided with three rotatable developing units 20Y, 20M, 20C and a black developing unit 21B which enable the development of yellow, magenta, cyan and black in order to visualize the electrostatic latent image.

During color image formation, a developing rotary 23 rotates for each one full rotation of the intermediate transfer body 9. The developing steps are carried out in the order of the yellow developing unit 20Y, the magenta developing unit 20M, the cyan developing unit 20C and lastly the black developing unit 21B.

Color Developing Units

Each of the three rotatable developing units 20Y, 20M and 20C contains therein a toner corresponding in quantity to about 7000 images (A4 size, print percentage of 4%). They are detachably attachably held on the developing rotary 23 as holding means rotated about a rotary shaft (hereinafter referred to as the shaft) 22. On this developing rotary 23, there is provided a mounting guide (not shown) as mounting means for detachably mounting the rotatable developing units 20Y, 20M and 20C. In case of image formation, the developing units 20Y, 20M and 20C are rotatively moved about the shaft 22 while being held on the developing rotary 23. A predetermined one of the developing units 20Y, 20M and 20C is stopped at a position opposed to the image bearing body 15.

During color toner image formation, the developing rotary 23 is rotated for each one full rotation of the intermediate transfer body 9 and the developing steps are carried out in the order of the yellow developing unit 20Y, the magenta developing unit 20M, the cyan developing unit 20C and the black developing unit 20B. The developer of the developing unit of each color is a non-magnetic monocomponent developer.

Figure 2:
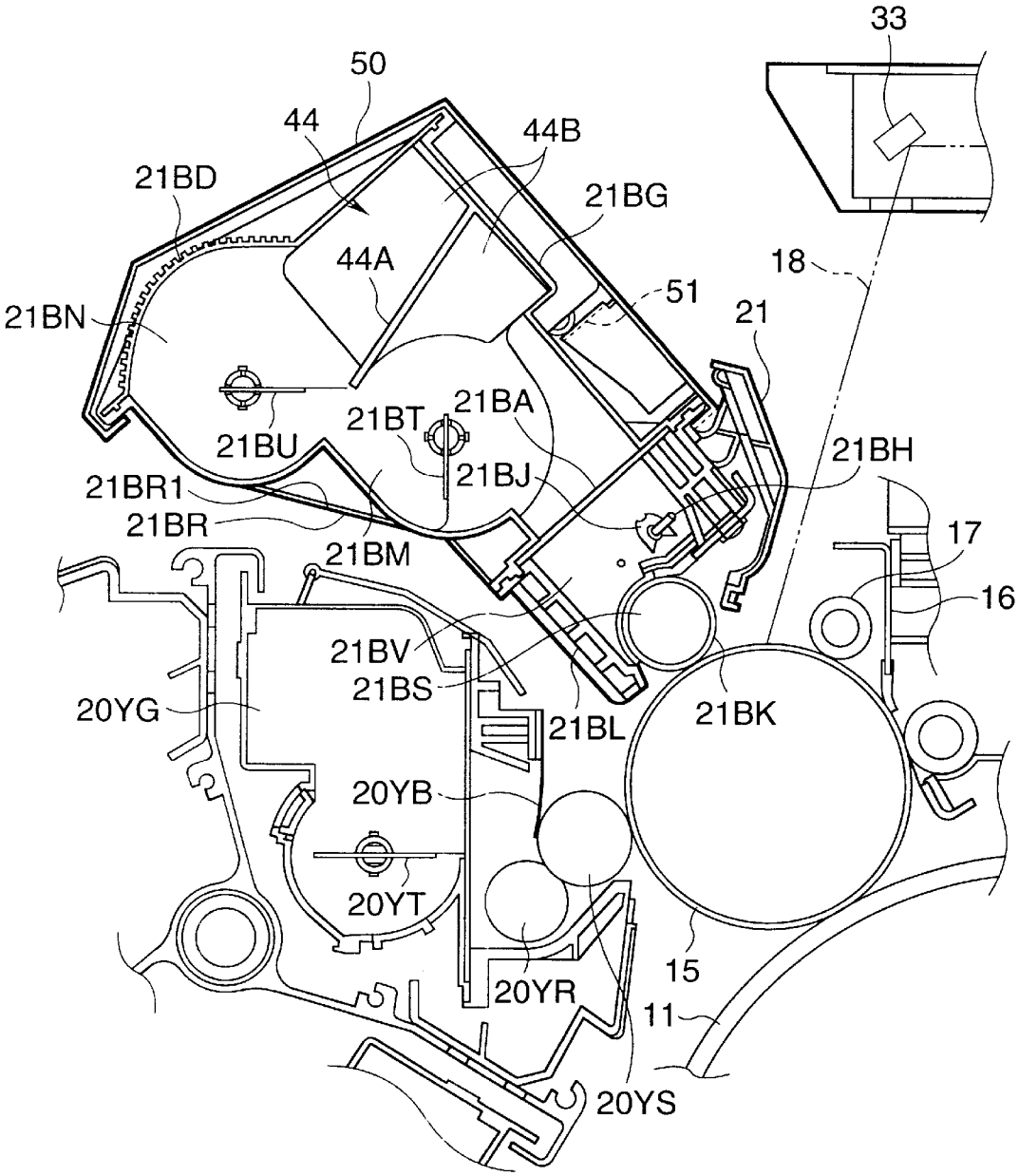
FIG. 2 is a cross-sectional view of the surroundings of a black developing unit in the embodiment.

FIG. 2 shows a state in which the yellow rotatable developing unit 20Y rests at a position opposed to the image bearing body 15. The rotatable developing unit 20Y feeds a yellow toner (yellow developer) in the container to an applying roller 20YR by a feeding member 20YT.

The yellow toner is applied in the form of a thin layer to the outer periphery of a developing roller 20YS rotated clockwise by the applying roller 20YR rotated clockwise and a developing blade 20YB urged against the outer periphery of a developing roller (cylinder member) 20YS as developing means, and charges are imparted (frictional charging) to the yellow toner.

A developing bias is applied to the developing roller 20YS opposed to the image bearing body 15 on which the latent images have been formed, whereby a yellow toner image is formed on the image bearing body 15 in conformity with the latent image. With respect also to the magenta developing unit 20M and the cyan developing unit 20C, toner development of each color is effected by a mechanism similar to what has been described above.

The yellow developing unit 20Y has the applying roller 20YR, the developing blade 20YB, the developing roller 20YS and a yellow toner containing portion 20YG containing a yellow toner therein. Likewise, the magenta developing unit 20M has an applying roller 20MR, a developing blade 20MB, a developing roller 20MS and a magenta toner containing portion MG containing a magenta toner therein. Also, the cyan developing unit 20C has an applying roller 20CR, a developing blade 20CB, a developing roller 20CS and a cyan toner containing portion CG containing a cyan toner therein (see FIG. 1).

Also, the developing rollers 20YS, 20MS and 20CS in the rotatable developing units 20Y, 20M and 20C, respectively, are connected to respective high voltage sources for color development and driving portions (none of these being shown) provided in the main body 100 of the printer when the developing units 20Y, 20M and 20C have been rotatively moved to the developing position. A voltage is selectively applied to each of the color developing units 20Y, 20M and 20C and the drive is connected.

Intermediate Transfer Body

The intermediate transfer body 9 receives the multiplex transfer of the toner images on the image bearing body 15 visualized by the respective developing units 20Y, 20M and 20C four times (the images of four colors Y, M, C and B) during the color toner image forming operation. Therefore, it is rotated clockwise in synchronism with the outer peripheral velocity of the image bearing body 15 (see FIG. 1).

Also, the intermediate transfer body 9 which has received the multiplex transfer conveys the recording medium 2 while sandwiching the recording medium 2 between the intermediate transfer body 9 and the transfer roller 10, to which a voltage has been applied, whereby the respective color toner images on the intermediate transfer body 9 are multiplexly transferred to the recording medium 2 at a particular time.

The intermediate transfer body 9 according to the present embodiment comprises an aluminum cylinder 12 having a diameter of 186 mm and an elastic layer 11 of medium resistance sponge, medium resistance rubber or the like covering the outer periphery thereof. This intermediate transfer body 9 is driven and rotated by a gear (not shown) rotatably supported on and fixed integrally with the main body 100 of the printer.

Cleaning Means

The cleaning means removes any toner remaining on the image bearing body 15 after the toner images visualized on the image bearing body 15 by the developing rollers (developing means) 20YS, 20MS, 20CS and 21BS of the developing units 20Y, 20M, 20C and 21B, respectively have been transferred to the intermediate transfer body 9. Thereafter, the removed toner is stored in the cleaner container 14. This cleaner container 14 can contain therein removed toner more than will be generated during the life (about 50,000 images) of the image bearing body 15.

Accordingly, when the image bearing body 15 reaches the end of its life, the cleaner container 14 is interchanged with it. In the present embodiment, a cleaning blade 16 is used as the cleaning member. This cleaning blade 16 abuts against the surface of the image bearing body 15.

Sheet Feeding Portion

The sheet feeding portion feeds the recording medium 2 to the image forming portion, and as shown in FIG. 1, it is comprised chiefly of a sheet feeding cassette 1 containing a plurality of recording mediums 2 therein, a feeding roller 3, a feeding roller 4, a double feeding preventing retard roller 5, a feeding guide 6, a conveying roller 7 and registration rollers 8.

During image formation, the feeding roller 3 is rotatively driven in response to the image forming operation and separates and feeds the recording mediums 2 in the sheet feeding cassette 1 one by one and also, the recording medium is guided by the feeding guide plate 6 and comes to the registration rollers 8 via the conveying roller 7.

During the image forming operation, the registration rollers 8 perform the non-rotating operation of making the recording medium 2 reset and wait and the rotating operation of conveying the recording medium 2 toward the intermediate transfer body 9, at a predetermined sequence, and effects the alignment between the toner image and the recording medium 2 during the transferring step, which is the next step.

Secondary Transfer Portion

The secondary transfer portion, as shown in FIG. 1, is provided with a transfer belt 10 pivotally movable as a transfer member. The transfer belt 10 is a belt having its surface layer formed of rubber of high resistance (the surface resistance being $10^9$ to $10^{13}$ Ω), and is vertically pivotally movable and rotatable.

During the time when the toner images on the intermediate transfer body 9 are being formed, i.e., during the time when the intermediate transfer body 9 is rotated a plurality of times, the transfer belt 10 is positioned below and spaced apart from the intermediate transfer body 9 as indicated by solid line so as not to disturb the images.

Specifically, during the time when toner images of four colors are being formed on the intermediate transfer body 9, i.e., during the time when the intermediate transfer body 9 is rotated a plurality of times, the transfer belt 10 is downwardly retracted relative to the intermediate transfer body 9 so as not to disturb those toner images.

After the toner images of four colors have been formed on the intermediate transfer body 9, the transfer belt 10 is urged against the intermediate transfer body 9 with predetermined pressure with the recording medium 2 interposed therebetween at an upper position indicated by thin line by a cam member, not shown, in synchronism with the timing at which the color toner images are transferred to the recording medium 2. At the same time, a bias is applied to the transfer belt 10 and therefore, the toner images on the intermediate transfer body 9 are transferred to the recording medium 2.

Each of the intermediate transfer body 9 and the transfer belt 10 is driven. Therefore, the recording medium 2 sandwiched between the two is subjected to the transferring step and at the same time, it is conveyed to the left (as viewed in FIG. 1) at a predetermined speed and is conveyed toward a heating and fixing device, which is the next step.

Fixing Portion

The toner images formed on the image bearing body 15 by the respective developing rollers (developing means) 20YS, 20MS, 20CS and 21BS of the developing units 20Y, 20M, 20C and 21B are transferred onto the recording medium 2 through the intermediate transfer body 9. The heating and fixing device 25 melts and mixes the toner images transferred onto the recording medium 2 by the use of heat and fixes the toner images on the recording medium 2.

As shown in FIG. 1, the heating and fixing device 25 is provided with a fixing roller for applying heat to the recording medium 2 and a pressing roller 27 for urging the recording medium 2 against the fixing roller 26, and the rollers 26 and 27 are hollow rollers. They have heaters 28 and 29 therein. They are rotatively driven to thereby convey the recording medium 2 at the same time.

That is, the recording medium 2 holding the toner image thereon is conveyed by the fixing roller 26 and the pressing roller 27 and has heat and pressure imparted thereto, whereby the toner image is fixed on the recording medium 2.

Black Developing Unit

The black developing unit 21B in the present embodiment is detachably fixed to and mounted in the main body 100 of the printer. That is, the black developing unit 21B is horizontally inserted into a unit containing portion through a mounting port provided in the main body 100 of the printer, and is detachably supported relative to a mounting guide (not shown) as mounting means provided in the unit containing portion. The black developing unit 21B has a toner containing portion 21BG as a developer containing portion containing a black toner therein, and the developing roller 21BS (see FIG. 2).

As shown in FIG. 2, the black developing unit 21B feeds the toner in the container into a first agitating portion 21BM by the second feeding member 21BU of a second agitating portion 21BN, and feeds the toner toward the developing roller 21BS by a first feeding member 21BT through an opening portion 21BA. The toner is applied to the outer peripheral surface of the developing roller 21BS by an applying blade (applying means) 21BB urged against the outer periphery of the developing roller 21BS and imparts charges (frictional charging) to the toner (see FIGS. 2 and 3).

A developing bias is applied to the developing roller 21BS to thereby effect reversal developing (jumping developing) correspondingly to the electrostatic latent image on the image bearing body 15, thus forming a toner image by the black toner on the surface of the image bearing body 15.

Figure 21:
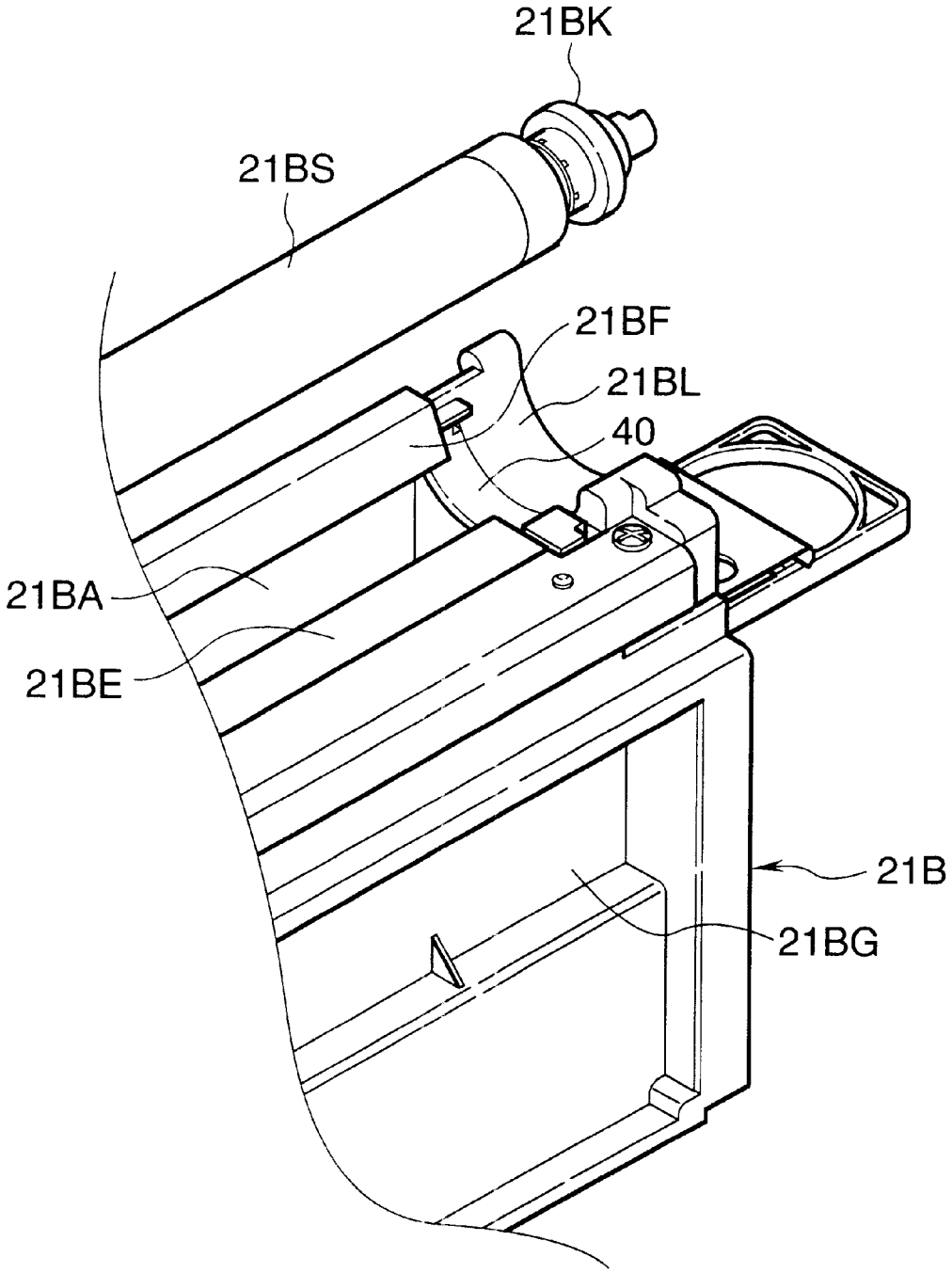
FIG. 21 is an enlarged perspective view of the black developing unit in the embodiment.

Spacer rollers 21BK are coaxially disposed on the opposite end portions of the developing roller 21BS of the black developing unit 21B, as shown in FIG. 21, and the outer diameter of the spacer rollers 21BK is slightly greater than the outer diameter of the developing roller 21BS.

These spacer rollers 21BK bear against the outer peripheral surface of the image bearing body 15, whereby the developing roller 21BS secures a minute interval (of the order 300 μm) relative to the image bearing body 15.

A toner image by the black toner is formed correspondingly to the electrostatic latent image on the image bearing body 15. The construction in which a minute interval is provided between the image bearing body 15 and the developing roller 21BS is similarly present in the other colors.

The toner capacity of the black developing unit 21B, with the amount of toner consumption taken into account, corresponds to 17000 images (A4 size, 4%) which is approximately double the toner capacity of the other rotatable developing units 20Y, 20M and 20C.

Also, the installed position of the black developing unit 21B is between a laser scanner portion 30 which is an exposure device and the rotatable developing units 20Y, 20M, 20C, as shown in FIG. 1.

By so disposing the black developing unit 21B, even if the toners leak when the rotatable developing units 20Y, 20M and 20C are rotated, the toners are prevented from scattering to optical parts such as the laser scanner portion 30, etc.

Thus, the toners are prevented from adhering to a polygon mirror 31, an imaging lens 32, a reflecting mirror 33, etc. and thereby hampering the latent image formation, and a clear output image can be obtained.

Measures for Preventing the Adherence of Floating Toners to the Bottom of the Toner Containing Portion The black developing unit 21B, as shown in FIGS. 1 and 2, is mounted in the main body 100 of the printer and the bottom 21BG1 of the toner containing portion 21BG thereof is opposed to the developing rotary 23. Therefore, color toners scattering from the developing units 20M, 20Y and 20C held by the developing rotary 23 and floating in the main body 100 of the printer may adhere to the bottom 21BG1 of the black developing unit 21B.

Figure 4:
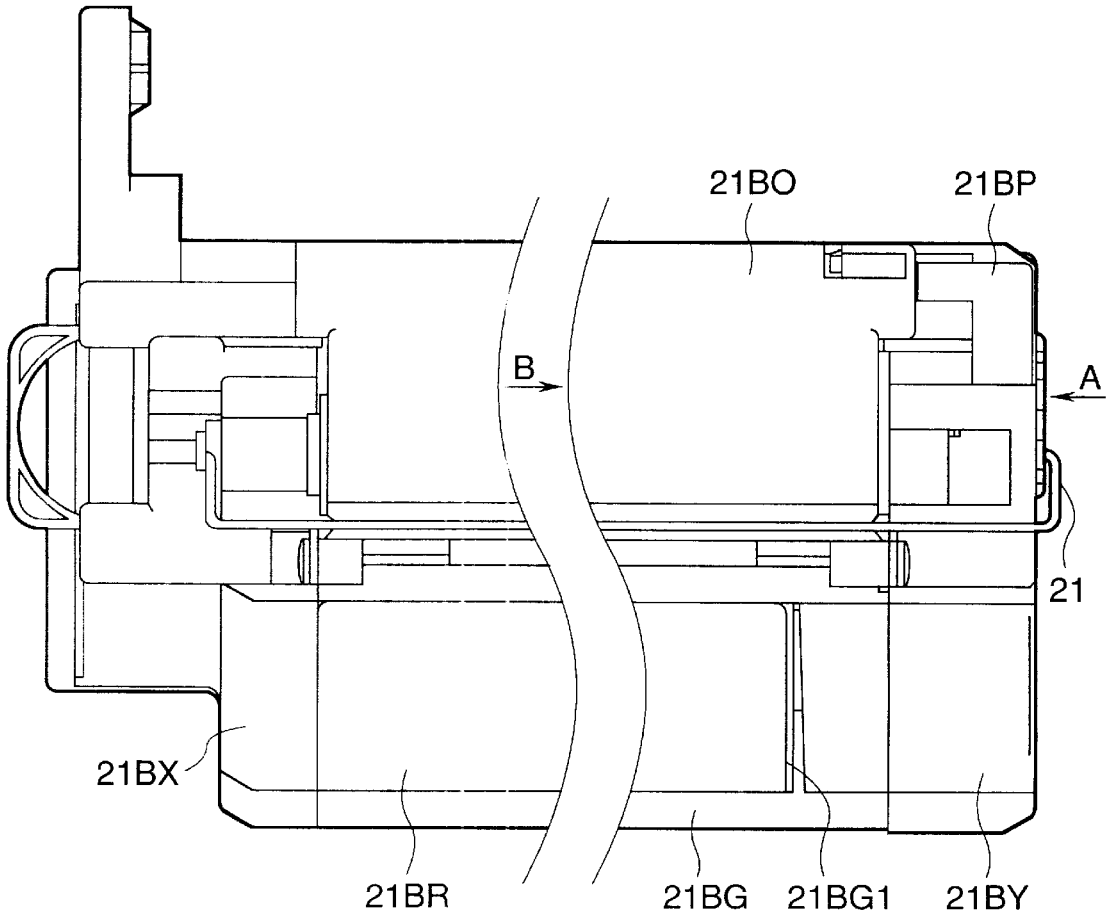
FIG. 4 is a front view of the black developing unit in the embodiment.

Thus, in the present embodiment, as shown in FIGS. 2 and 4, a cover sheet 21BR which is a low resistance member is adhesively secured to the bottom surface of the bottom 21BG1 of the toner containing portion 21BG. In the present embodiment, the cover sheet 21BR is formed of a super-high molecular polyethylene sheet material having surface resistance $10^6$ Ω or less (specifically, surface resistivity of $10^{13}$ Ω/sq. or less).

The cover sheet 21BR is of low resistance and therefore its surface is not significantly charged. Also, it is formed of a sheet material of a low coefficient of friction, such as a super-high molecular polyethylene sheet material, and therefore is excellent in the slipping property of its surface. By these two characteristics, the adherence of the color toners floating in the main body 100 of the printer is prevented.

Thus, the adherence of the color toners to the bottom 21BG1 of the toner containing portion 21BG can be prevented and therefore, there can be realized a black developing unit 21B excellent in usability.

Although not shown, the cover sheet 21BR is formed with an aperture in least one location. By virtue of the cover sheet 21BR being formed with an aperture in at least one desired location as described above, the air in the space of the housing of the cover sheet 21BR and the toner containing portion 21BG can be drawn out when the cover sheet 21BR is adhered to the bottom 21BG1 of the toner containing portion 21BG, and the cover sheet 21BR can be prevented from being wrinkled during the adhesive securing thereof. Also, the air in the space of the housing of the cover sheet 21BR and the toner containing portion 21BG can be prevented from being expanded by temperature rise to thereby inflate the cover sheet 21BR.

Construction of the Housing of the Black Developing Unit

Figure 23:
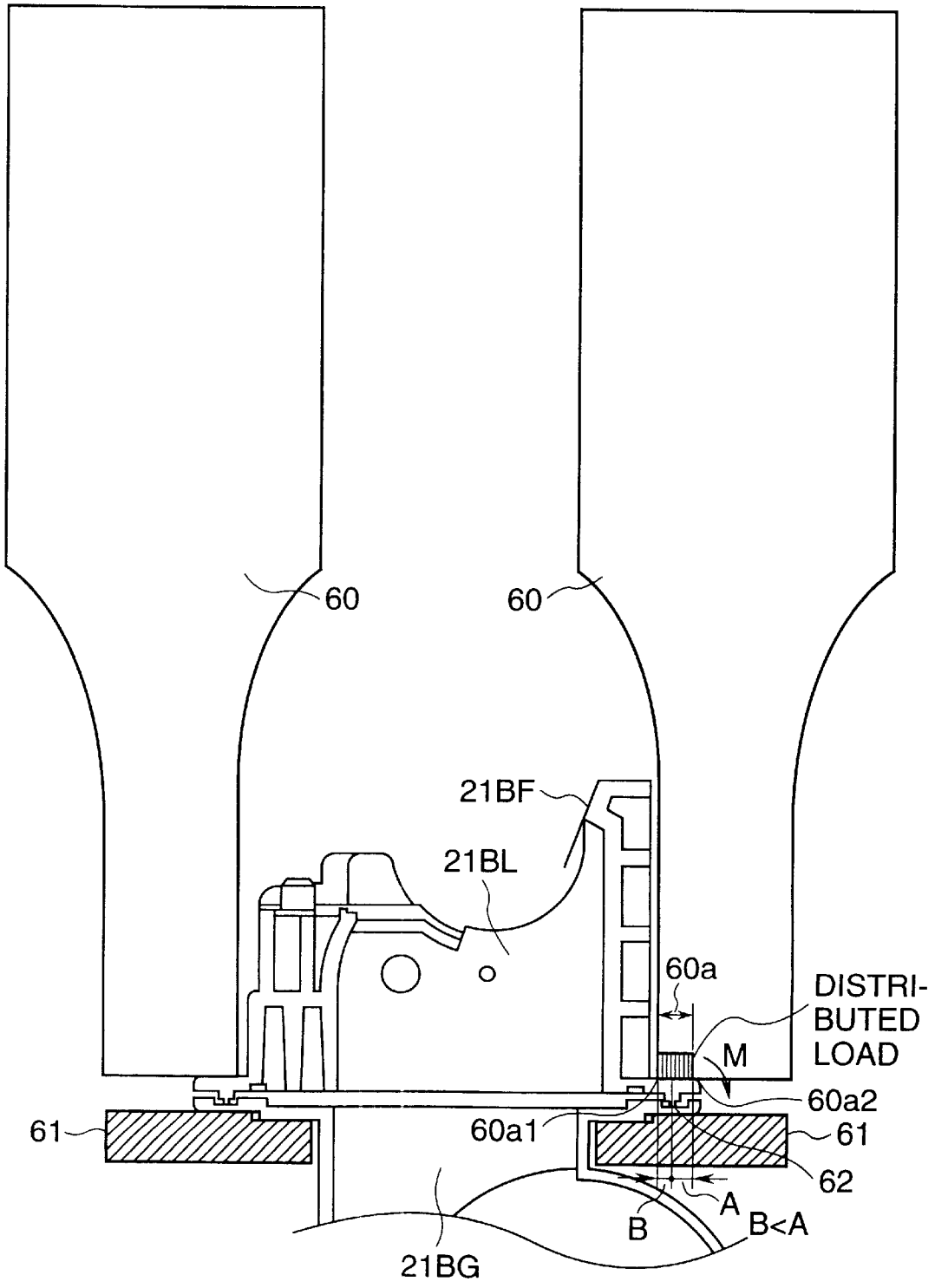
FIG. 23 is a joint cross-sectional view of the black developing unit in the embodiment.

The black developing unit 21B, as shown in FIG. 23, comprises a toner containing portion 21BG and a developing portion frame 21BL coupled together by an ultrasonic joining method.

A projected portion 62 is formed on a portion of the developing portion frame 21BL, and the projected portion 62 bears against the bottom surface 63*a* of a recess 63 formed in a portion of the housing of the toner containing portion 21BG.

When in this state, a portion of the housing of the toner containing portion 21BG is held by a pedestal 61 and a portion of the developing portion frame 21BL is pressed and vibrated by a horn 60, the projected portion 62 is melted in the recess 63, and the toner containing portion 21BG and the developing portion frame 21BL are joined together.

The conventional ultrasonic joining method for the toner containing portion 21BG and the developing portion frame 21BL will now be described with reference to FIG. 21.

Figure 22:
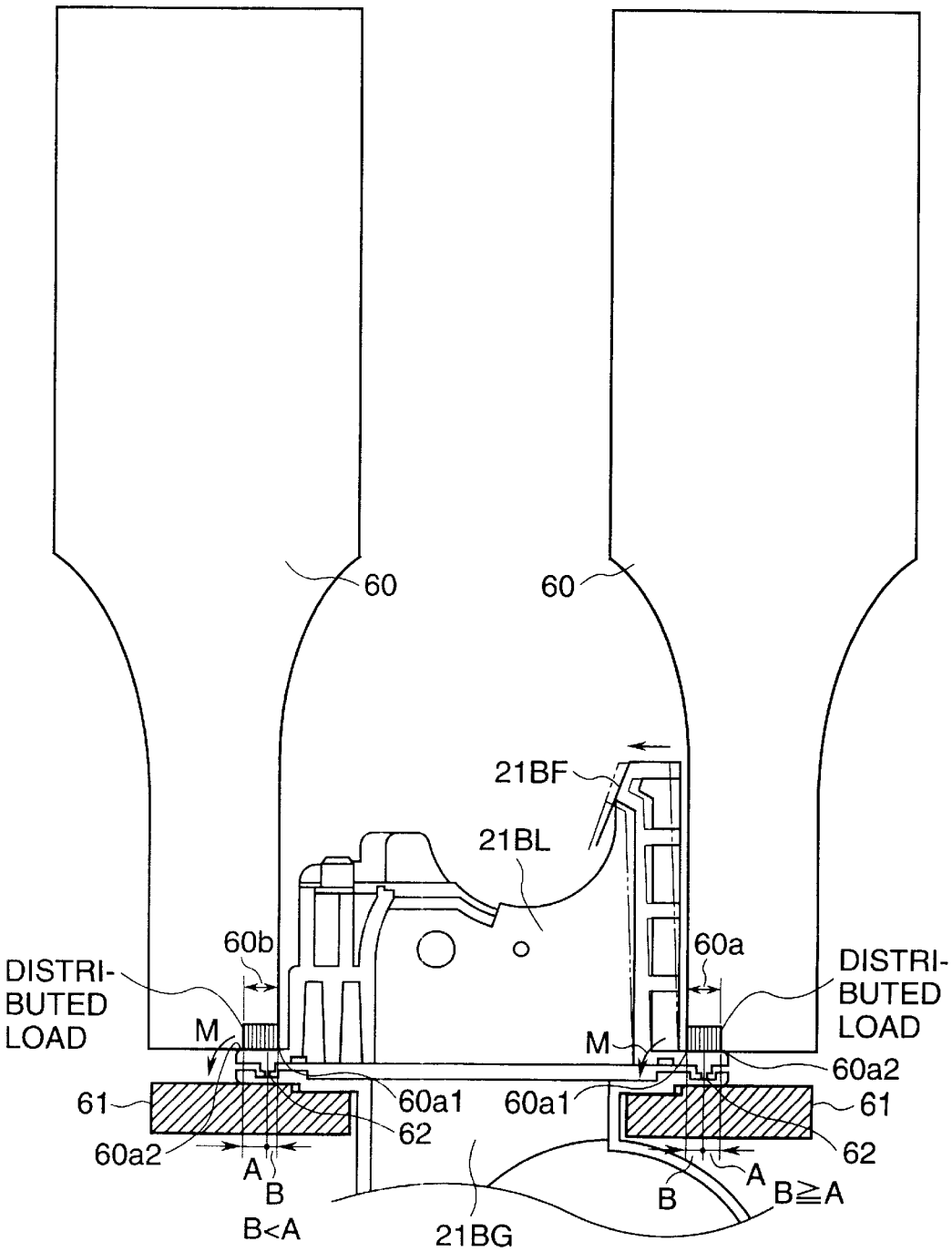
FIG. 22 is a joint cross-sectional view of a black developing unit according to the prior art.

As shown in FIG. 22, the toner containing portion 21BG and the developing portion frame 21BL have been ultrasonically joined together, in a state in which when on a blow-out preventing sheet 21BF side provided on the developing portion frame 21BL, the distance between the inner end 60*a*1 of a close contact area 60*a* in which a horn 61 is in close contact with the developing portion frame 21BL and the projected portion 62 of the developing portion frame 21BL is defined as B and the distance between the outer end 60*a*2 of the close contact area 60*a* in which the horn 61 is in close contact with the developing portion frame 21BL and the projected portion 62 of the developing portion frame 21BL is defined as A, B and A are adjusted so that B≧A, and in a state when on the side opposite to the blow-out preventing sheet 21BF of the developing portion frame 21BL, the distance between the inner end 60*b* of a close contact area 60*b* in which the horn 61 is in close contact with the developing portion frame 21BL and the projected portion 62 of the developing portion frame 21BL is defined as B and the distance between the outer end 61*b*2 of the close contact area 60*b* in which the horn 61 is in close contact with the developing portion frame 21BL and the projected portion 62 of the developing portion frame 21BL is defined as A, B and A are adjusted so that B<A.

In such an ultrasonic joining method, however, the moment M of the distance B by the pressing force (distribution load) of the horn 60 in the close contact areas 60*a* and 60*b* of the developing portion frame 21BL is great as compared with the moment (not shown) of the distance A and therefore, the housing of the developing portion frame 21BL is deformed inside an opening indicated by arrow A. As a result, the blow-out preventing sheet (blow-out preventing means) 21BF strongly abuts against the developing roller 21BS, not shown, and scrapes off a part of the black toner applied to the developing roller 21BS. This causes either the floating of the black toner or an uneven image to occur in the portion wherein the blow-out preventing sheet strongly abuts against the developing roller 21BS.

So, in the present embodiment, when the toner containing portion 21BG and the developing portion frame 21BL are to be joined together, when, as shown in FIG. 23, the distance between the inner end 60*a*1 of the close contact area 60*a* in which the horn 60 is in close contact with the developing portion frame 21BL and the projected portion 62 is defined as B, and the distance between the outer end 60*a*2 of the close contact area 60*a* in which the horn 60 is in close contact with the developing portion frame 21BL and the projected portion 62 is defined as A, B and A are adjusted so that B<A.

By effecting the adjustment of the joint as previously described, the warp of the developing portion frame 21BL can be made small. That is, in the ultrasonic joining method according to the present embodiment, the moment M of the distance A by the pressing force (distribution load) of the horn 60 in the close contact area 60*a* of the developing portion frame 21BL becomes great as compared with the moment (not shown) of the distance B. Therefore, it can be corrected for the housing of the developing portion frame 21BL to be deformed toward the inside of an opening indicated by arrow A in FIG. 23. As a result, the warp of the blow-out preventing sheet 21BF adhesively secured to the developing portion frame 21BL becomes small and the blow-out preventing sheet 21BF can be made to stably abut against the developing roller 21BS.

Thereby, it becomes possible to effect the stable application of the black toner to the developing roller 21BS, and both the occurrence of the floating or scattering of the black toner by the blow-out preventing sheet 21BF scraping off part of the black toner applied to the developing roller 21BS and the occurrence of an uneven image in the portion wherein the blow-out preventing sheet 21BF strongly abuts can be suppressed.

The aforedescribed joining method can also be suitably applied to the yellow developing unit 20Y, the magenta developing unit 20M and the cyan developing unit 20C.

Supporting Structure for the Agitating Member of the Developing Portion

Figure 3:
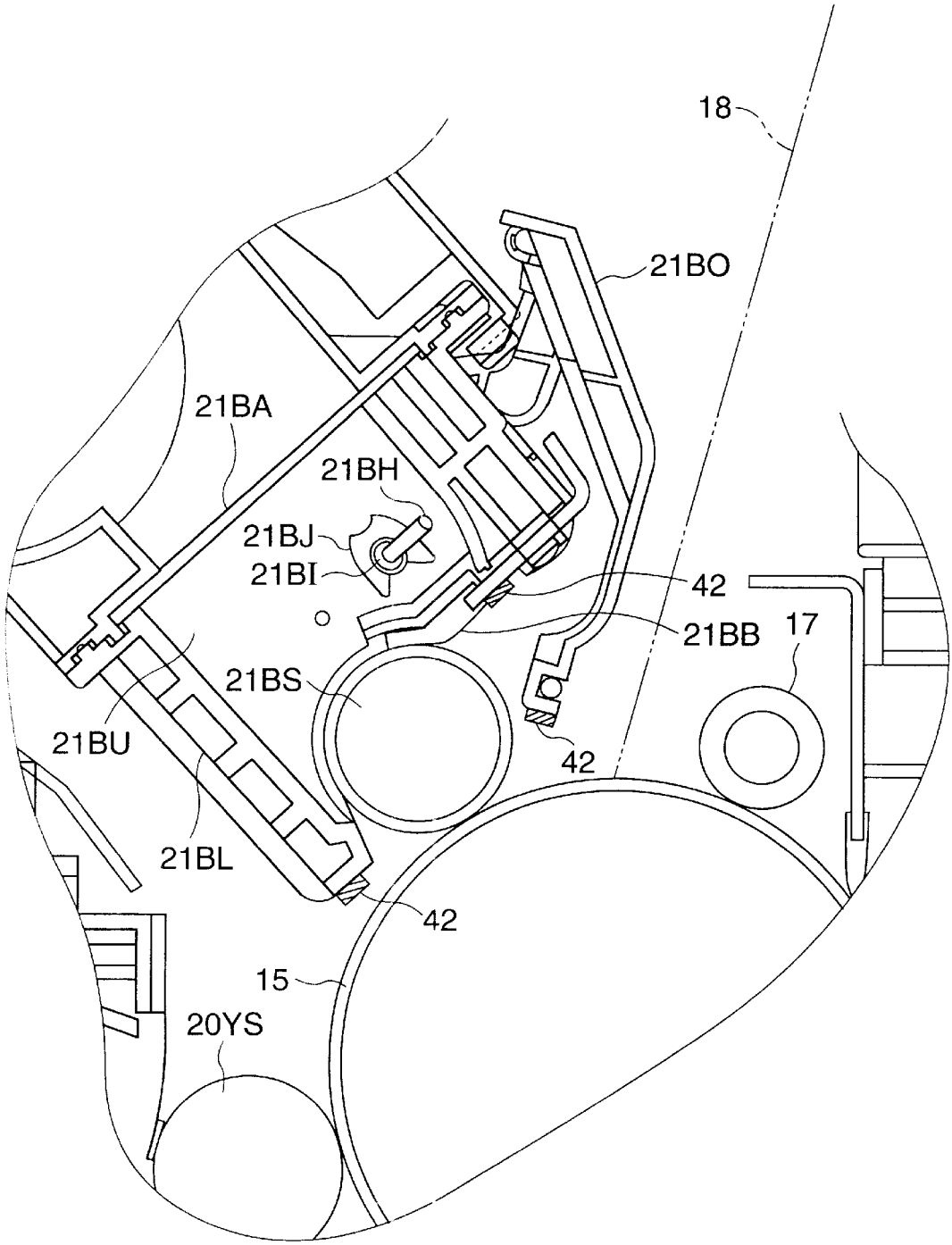
FIG. 3 is an enlarged cross-sectional view of the black developing unit in the embodiment.
Figure 5:
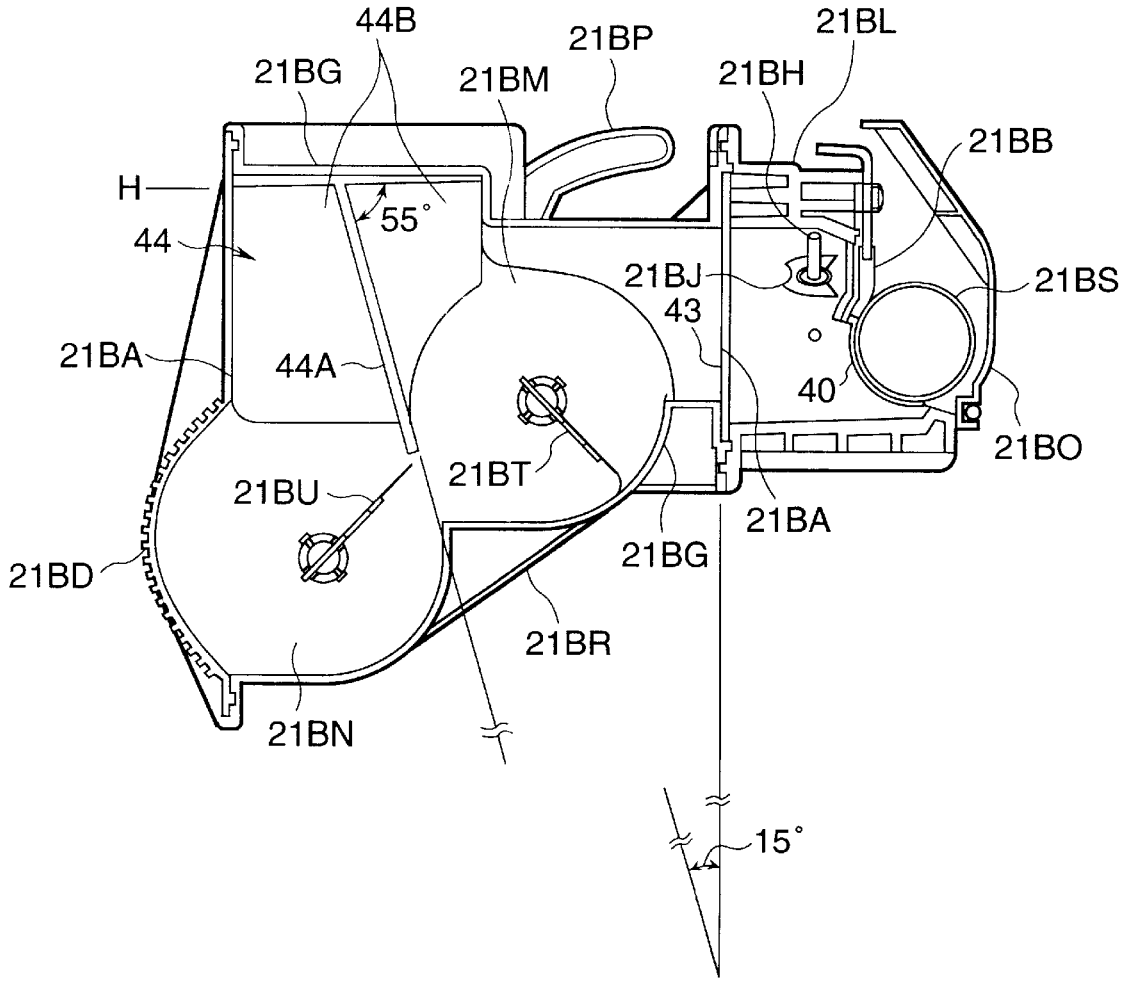
FIG. 5 is a main cross-sectional view of the black developing unit in the embodiment.
Figure 16:
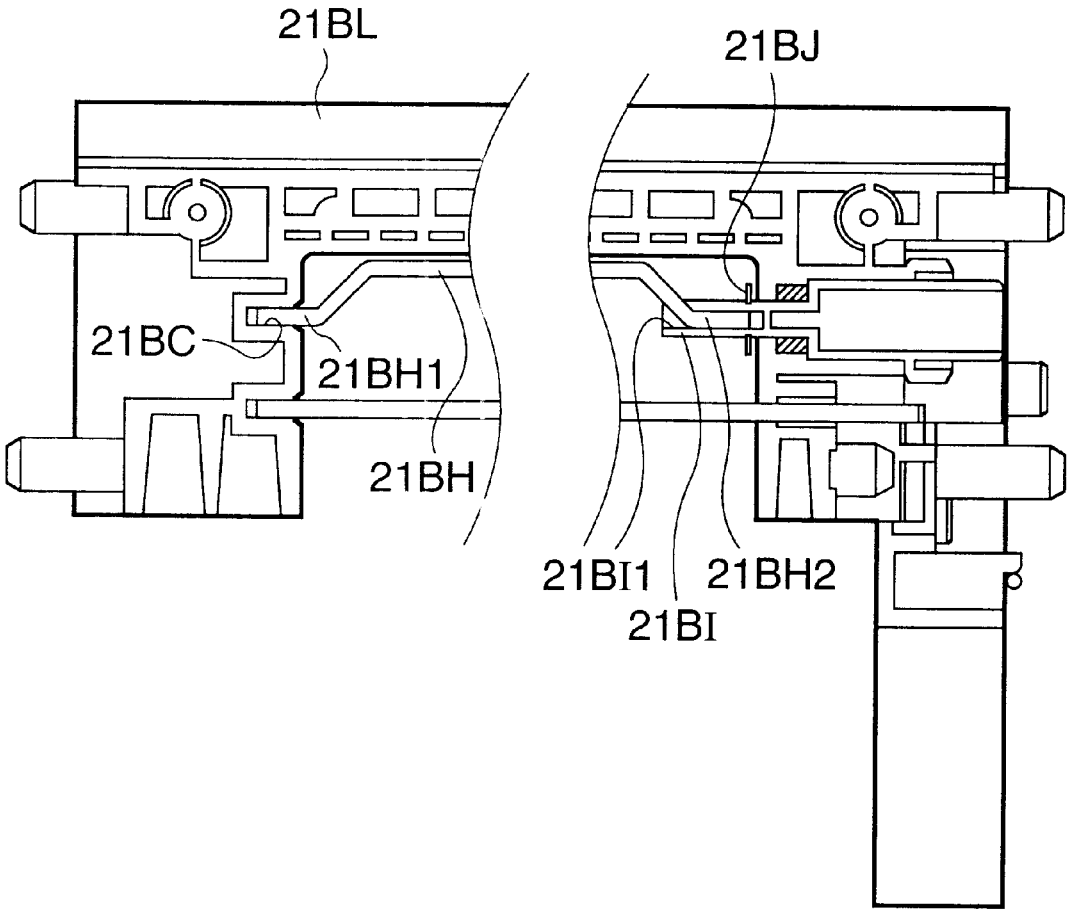
FIG. 16 is a cross-sectional view of a developing portion frame in the black developing unit in the embodiment.

Also, as shown in FIGS. 2, 3 and 5, an agitating member (developer agitating member) 21BH and a rotatable member 21BI are disposed in the developing portion 21BV. The agitating member 21BH in the present embodiment, as shown in FIG. 16, has one end portion 21BH1 thereof supported in an aperture 21BC in the developing portion frame 21BL, and has the other end portion 21BH2 thereof supported in an aperture 21BI1 in the rotatable member 21BI. The agitating member 21BH is fixed against axial movement relative to the rotatable member 21BI.

Figure 18:
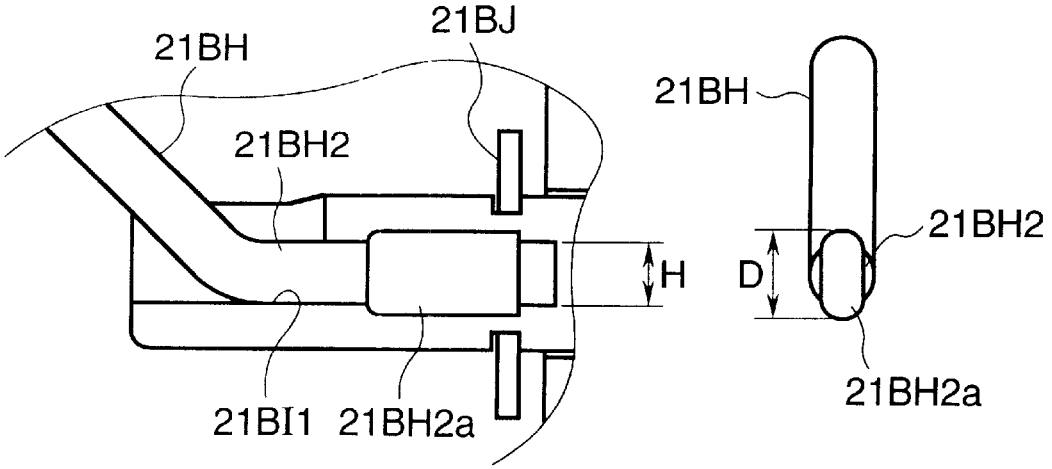
FIG. 18 is an enlarged cross-sectional view showing the manner of assembling the agitating member in the black developing unit in the embodiment.

Specifically, as shown in FIG. 18, a portion 21BH2*a* of the other end portion 21BH2 of the agitating member 21BH is pressed and thickened, and this thick portion 21BH2*a* is forced into the aperture 21BH1 in the rotatable member 21BI. In the present embodiment, the height dimension D of the thick portion 21BH2*a* of the agitating member 21BH and the diameter H of the aperture 21BI1 in the rotatable member 21BI are in the dimensional relation that $D-H \geqq 0.1$ mm.

By adopting the above-mentioned dimensional relation, the pull strength of the agitating member 21BH relative to the rotatable member 21BI can be 500 gf.

Figure 17:
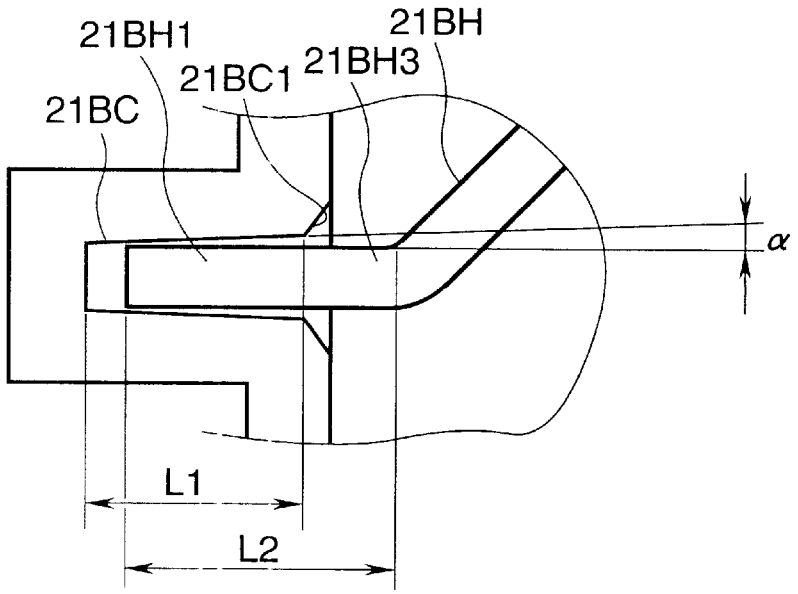
FIG. 17 is an enlarged cross-sectional view showing the manner of assembling an agitating member in the black developing unit in the embodiment.

On the other hand, the aperture 21BC in the developing portion frame 21B is of a tapered shape as shown in FIG. 17 so that one end portion 21BH1 of the agitating member 21BH may not slide. Specifically, the taper angle is $\alpha \geqq 2°$ with respect to the peripheral surface of one end portion 21BH1 of the agitating member 21BH.

Also, in the present embodiment, when the depth of the aperture 21BC in the developing portion frame 21BL is defined as L1 and the length of the straight portion of one end portion 21BH1 of the agitating member 21BH is defined as L2, L2>L1. By adopting such a dimensional relation, the bend root 21BH3 of one end portion 21BH1 of the agitating member 21BH is prevented from axially interfering with the entrance of the aperture in the developing portion frame 21BL.

Also, the entrance of the aperture 21BC in the developing portion frame 21BL is chamfered at 21BC1 and is made to escape more positively relative to the bend root 21BH3 of the agitating member 21BH so that the interference with the bend root 21BH3 of the agitating member 21BH may not occur.

In the agitating member 21BH in the present embodiment, a stopper 21BJ as an anti-slippage member is held on the inner side of the rotatable member 21BI so that the agitating member may not fall off the developing portion frame 21BL after the assembly thereof.

As described above, in the agitating member supporting structure according to the present embodiment, the agitating member 21BH is fixed against axial movement relative to the rotatable member 21BI and therefore, the axial reciprocal movement of the agitating member 21BH can be suppressed. Thus, it never happens that the black toner is positively forced into the aperture 21BC in the developing portion frame 21BL.

Also, the aperture 21BC in the developing portion frame 21BL is provided with a taper angle of 2° or greater with respect to the peripheral surface of one end portion 21BH1 of the agitating member 21BH. Therefore, with the rotating operation of the agitating member 21BH, the black toner can be discharged from the aperture 21BC. Moreover, the circumferential surface of one end portion 21BH1 of the agitating member 21BH is not in surface contact with the aperture 21BC and therefore, the adherence of the black toner to the inner surface of the aperture 21BC can be reduced.

Also, since the dimensional relation between the depth L1 of the aperture 21BC in the developing portion frame 21BL and the length L2 of the straight portion of one end portion 21BH1 of the agitating member 21BH is L2>L1, it can be avoided for the bend root 21BH3 of the agitating member 21BH to axially interfere with the entrance of the aperture 21BC in the developing portion frame 21BL, and such a situation that the black toner adheres to the entrance of the aperture 21BC in the developing portion frame 21BL can be prevented.

The aforedescribed agitating member supporting structure can also be suitably applied to the yellow developing unit 20Y, the magenta developing unit 20M and the cyan developing unit 20C.

In the present embodiment, the aperture 21BC is formed in the developing portion frame 21BL to support one end portion 21BH1 of the agitating member 21BH. However, as an alternative to the aperture 21BC, a groove can be formed in the developing portion frame 21BL to thereby support one end portion 21BH1 of the agitating member 21BH.

Measure for Catching the Toner in the Developing Portion

Figure 6:
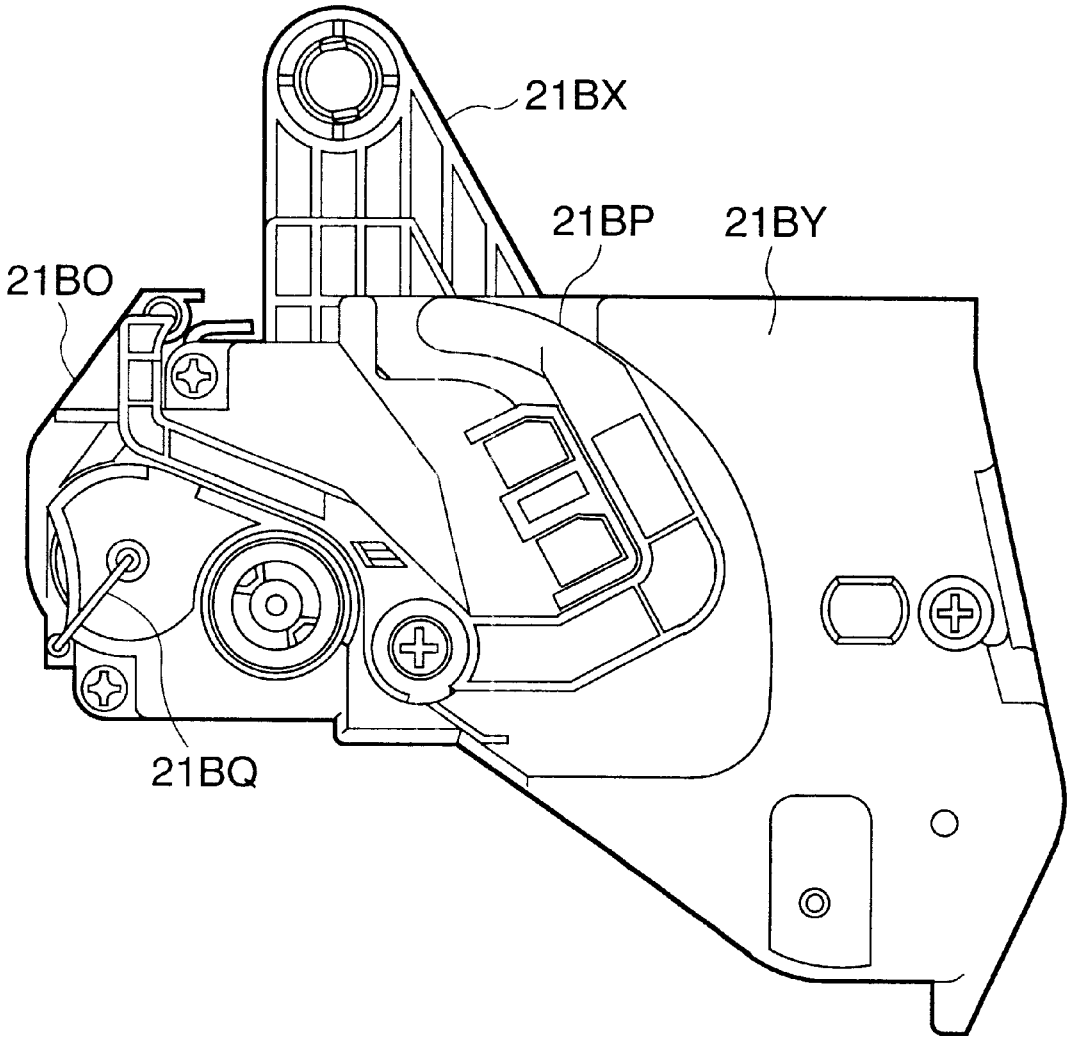
FIG. 6 is a side view of the black developing unit in the embodiment.
Figure 26:
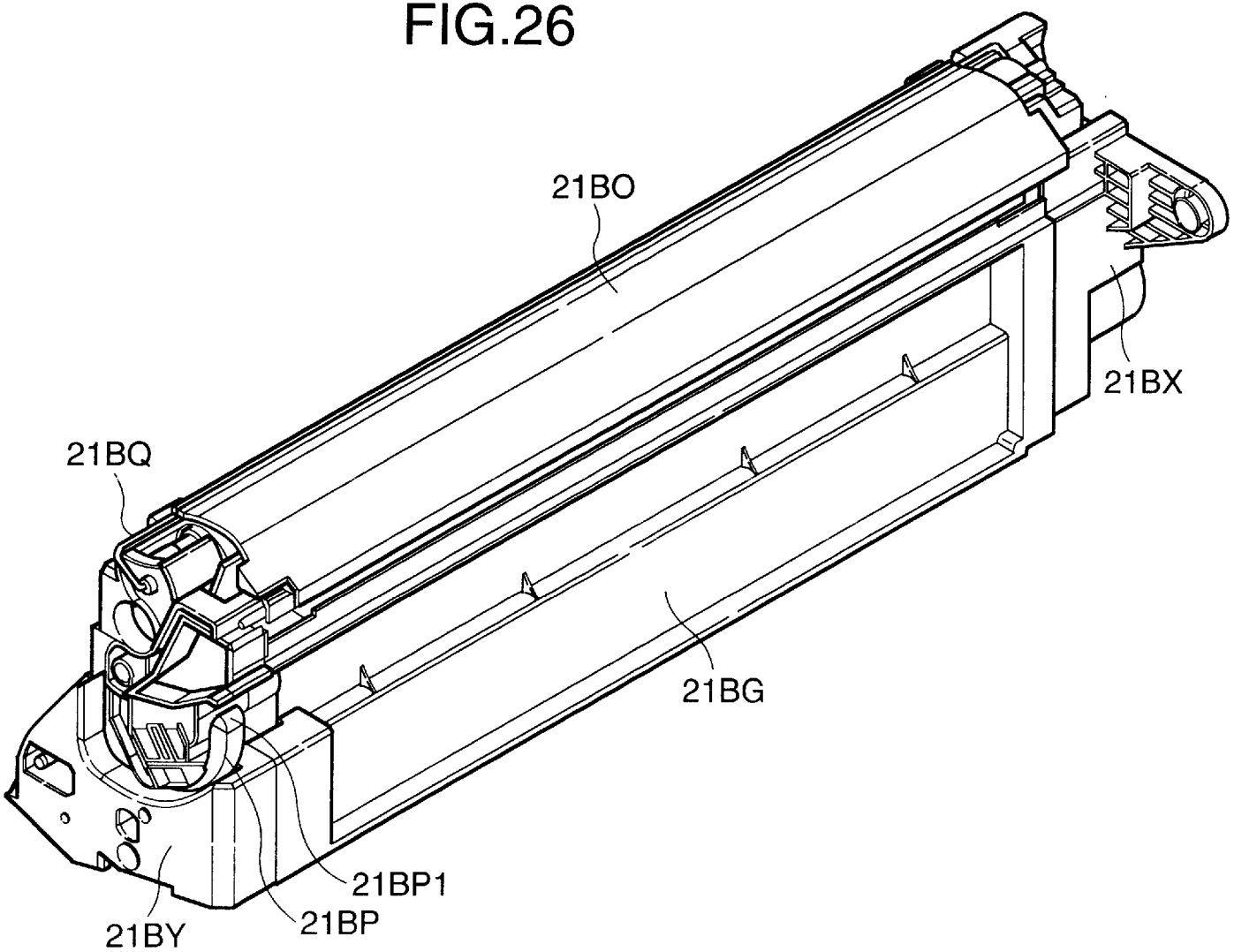
FIG. 26 is a pictorial perspective view of the black developing unit in the embodiment.

Also, in the developing portion 21BV, as shown in FIGS. 2, 3 and 5, there are disposed, besides the agitating member 21BH, the developing roller 21BS, the applying blade 21BB, an openable shutter (protective member) 21BO for protecting the developing roller 21BS, etc. The shutter 21BO, as shown in FIGS. 4, 6 and 26, is openably supported on the developing portion frame 21BL through a shutter shaft 21BQ, and is opened to thereby expose the developing roller 21BS when the black developing unit 21B is mounted in the main body 100 of the printer, and is closed to thereby protect the developing roller 21BS when the black developing unit 21B is detached from the main body 100 of the printer.

In the present embodiment, as shown in FIG. 3, a magnet sheet 42 as developer catching means is disposed within 15 mm from the surface of the developing roller 21BS. It can be mounted by being adhesively secured, for example, to a portion of the developing portion frame 21BL, a portion of the shutter 21BO or a portion of the applying blade 21BB.

The full length of the magnet sheet 42 is longer than the application area (coat length) of the black toner applied onto the developing roller 21BS. Also, the magnet sheet 42 is disposed parallel to the axis of the developing roller 21BS.

By so disposing the magnet sheet 42, the toner floating from the developing roller 21BS (the toner floating around the developing roller 21BS) can be positively caught (captured) by the utilization of the adsorbing action by the magnetic force of the magnet sheet 42. Thereby, the stains of the housing of the black developing unit 21B by the black toner and the contamination of the outer surface of the drum unit 13 disposed near the black developing unit 21B can be prevented.

By so disposing the magnet sheet 42 as developer catching means in the developing portion 21BV, the black toner can be prevented from adhering to the other areas other than the developing portion 21BV.

Measure for Reducing the Toner Pressure to an Opening Seal Member by Falling (1)

Figure 7:
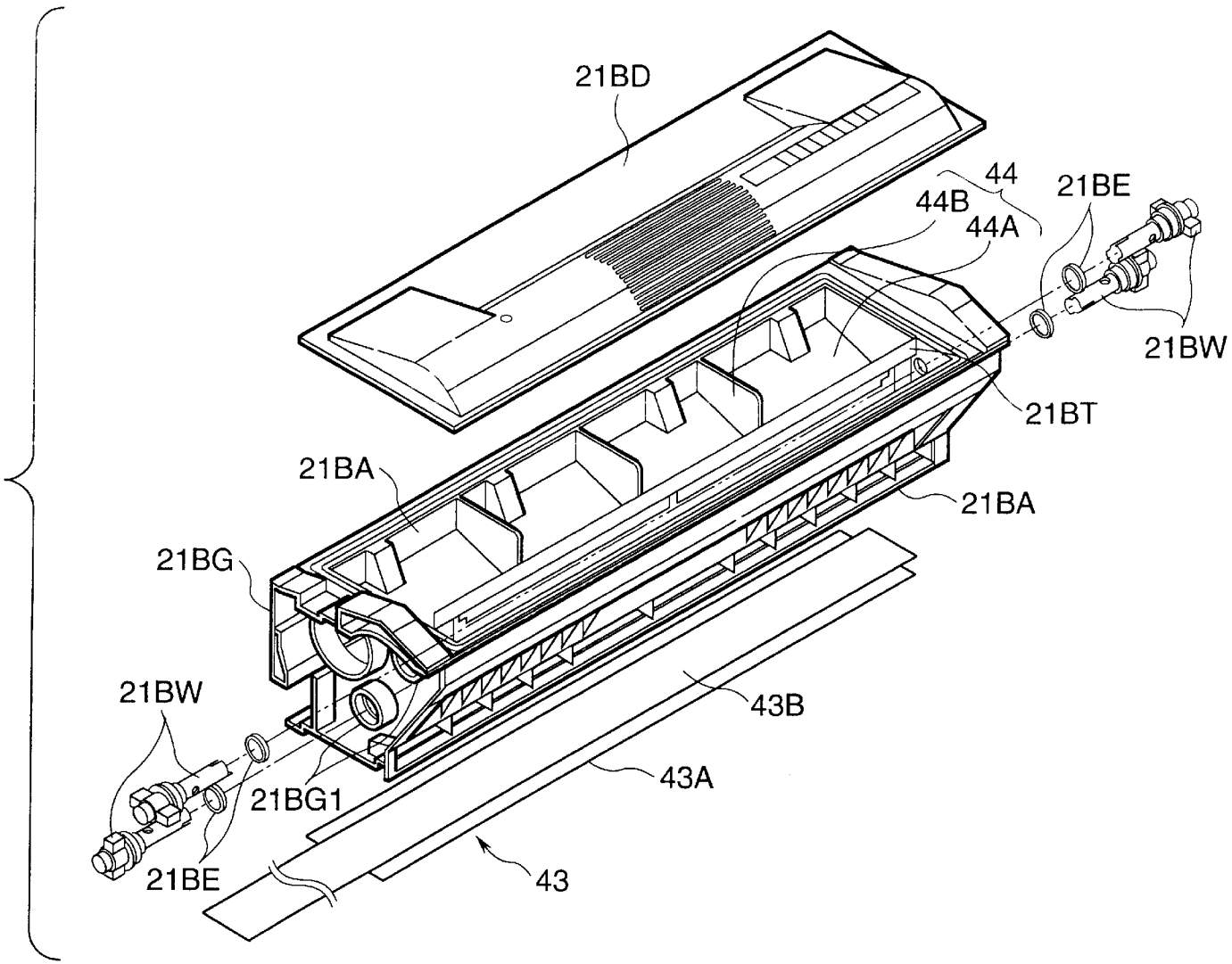
FIG. 7 is an exploded perspective view of a toner containing portion in the black developing unit in the embodiment.

The toner containing portion 21BG, as shown in FIG. 7, is formed with upper and lower opening portions 21BA, and the upper opening portion 21BA is sealed with a lid 21BD joined thereto, and the lower opening portion 21BA is sealed with an opening seal member 43 adhesively secured thereto.

The direction of detachment of the black developing unit 21B relative to the main body 100 of the printer is the same as the lengthwise direction of the black developing unit 21B (the axial direction of the developing roller 21BS).

Just above the lower opening portion 21BA, there is provided a partition member 44 which partitions the interior of the toner containing portion 21BG into a plurality of containing chambers. This partition member 44 includes a first partition wall 44A extending in the direction of detachment of the black developing unit 21B relative to the main body 100 of the printer, and a plurality of second partition walls 44B extending in a direction perpendicular to the direction of detachment of the black developing unit 21B relative to the main body 100 of the printer.

The first partition wall 44A of the partition member 44 is formed so that the wall surface thereof may be larger than the opening area of the lower opening portion 21BA (see FIG. 5).

Also, the first partition wall 44A is disposed so that, as shown in FIG. 5, the wall surface thereof may have an angle of inclination of 30° or less (in the present embodiment, an angle of inclination of about 15°) with respect to the adhesively secured surface of the opening seal member 43 and have an angle of inclination of 65° or less (in the present embodiment, an angle of inclination of about 55°) with respect to the horizontal plane H of the main body 100 of the printer.

The first partition wall 44A is formed and disposed in the toner containing portion 21BG as described above and thus, the black toner trying to be moved toward the opening seal member 43 side by the shock or vibration to the black developing unit 21B during shipment impinges on the wall surface of the first partition wall 44A, whereby the movement of the black toner toward the opening seal member 43 side can be blocked by the first partition wall 44A.

Thereby, the powder pressure to the opening seal member 43 by the black toner can be reduced and the breakage or the like of the opening seal member 43 by the powder pressure of the black toner can be suitably prevented.

Also, the plurality of second partition walls 44B of the partition member 44 are provided in the toner containing portion 21BG in a direction perpendicular to the direction of detachment of the black developing unit 21B relative to the main body 100 of the printer. Therefore, the black toner can be distributed to the toner containing chambers among the second partition walls 44B, and the inclination of the black toner in the toner containing portion 21BG can be reduced.

Measure for Reducing the Toner Pressure to the Opening Seal Member by Falling (2)

Also, a first agitating portion 21BM and a second agitating portion 21BN are in the interior of the toner containing portion 21BG, and a first feeding member 21BT and a second feeding member 21BU are rotatably supported on the respective agitating portions 21BM and 21BN.

In the present embodiment, the endmost portion of the second feeding member 21BU in the direction of rotational radius thereof is stopped so as to be opposed to the tip end portion of the first partition wall 44A of the partition member 44 (see FIG. 5).

Further, the first feeding member 21BT and the second feeding member 21BU are provided with a phase difference of an angle of rotation of about 90° (specifically, 90°±15°). Particularly, the first feeding member 21BT is stopped at a position rotated by about 90° toward the upstream side relative to the second feeding member 21BU.

In a factory, the first feeding member 21BT and the second feeding member 21BU are adjusted to the previously described stopped positions and are shipped.

As described above, the second feeding member 21BU is stopped so that the embodiment portion thereof may be opposed to the tip end portion of the first partition wall 44A, and the second feeding member 21BU is stopped with its phase of rotation shifted to the upstream side of about 90° relative to the first feeding member 21BT. Therefore, in the toner containing portion 21BG, a substantially meandering space portion is formed by the first partition wall 44A, the second feeding member 21BU and the first feeding member 21BT. Thus, the black toner trying to be moved toward the opening seal member 43 side by the shock or vibration to the black developing unit 21B during shipment impinges on the first partition wall 44A, the second feeding member 21BU or the first feeding member 21BT, and the movement of the black toner toward the opening seal member 43 side can be blocked by the first partition wall 44A, the second feeding member 21BU and the first feeding member 21BT.

The driving shafts 21BW of the first feeding member 21BT and the second feeding member 21BU, as shown in FIG. 7, are inserted into a side aperture 21BG1 in the toner containing portion 21BG with oil seals 21BE. The first and second feeding members 21BT and 21BU are driven and rotated by the driving shafts 21BW.

Construction of the Opening Seal Member

Figure 8:
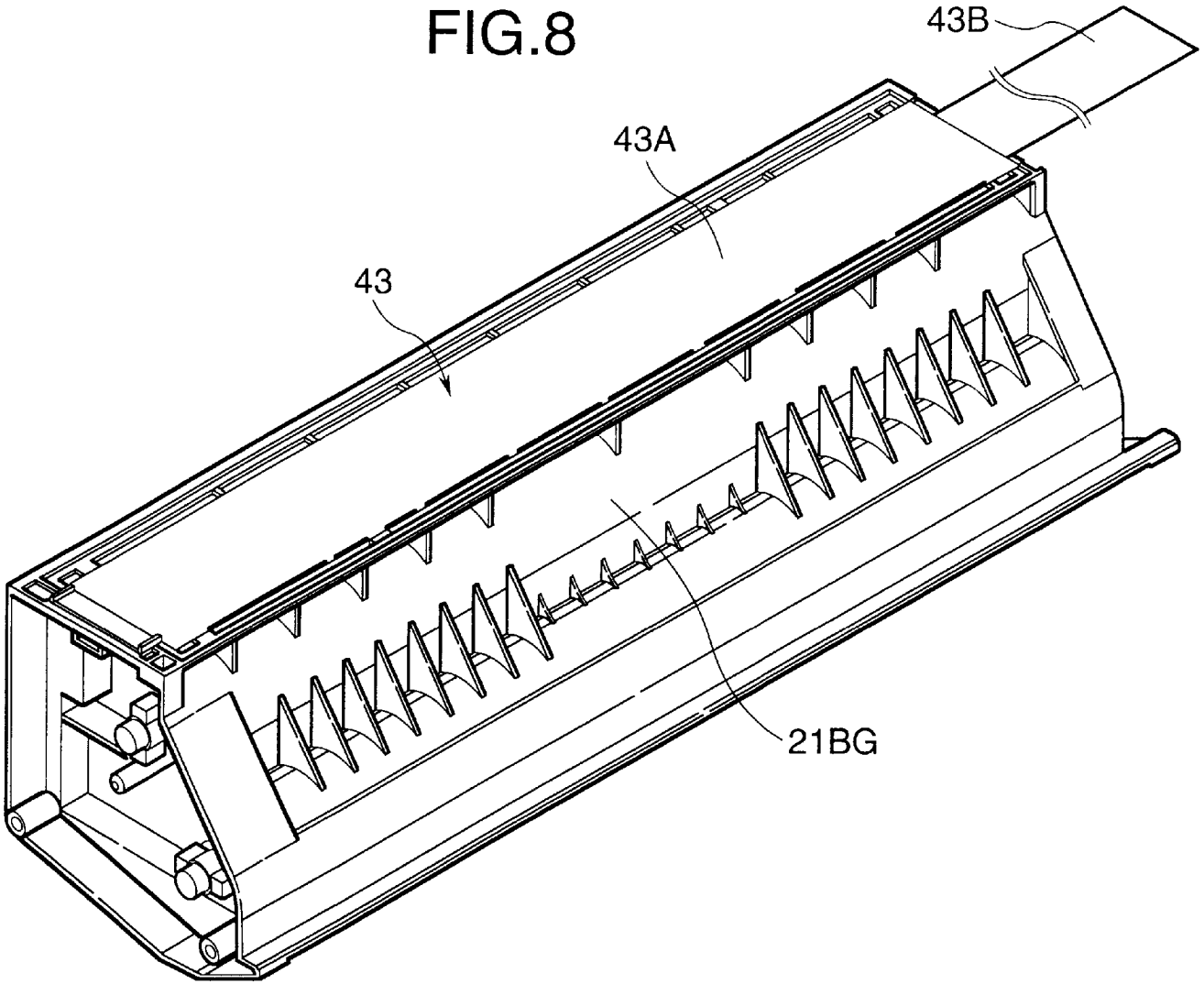
FIG. 8 is a perspective view of the toner containing portion in the black developing unit in the embodiment.
Figure 9:
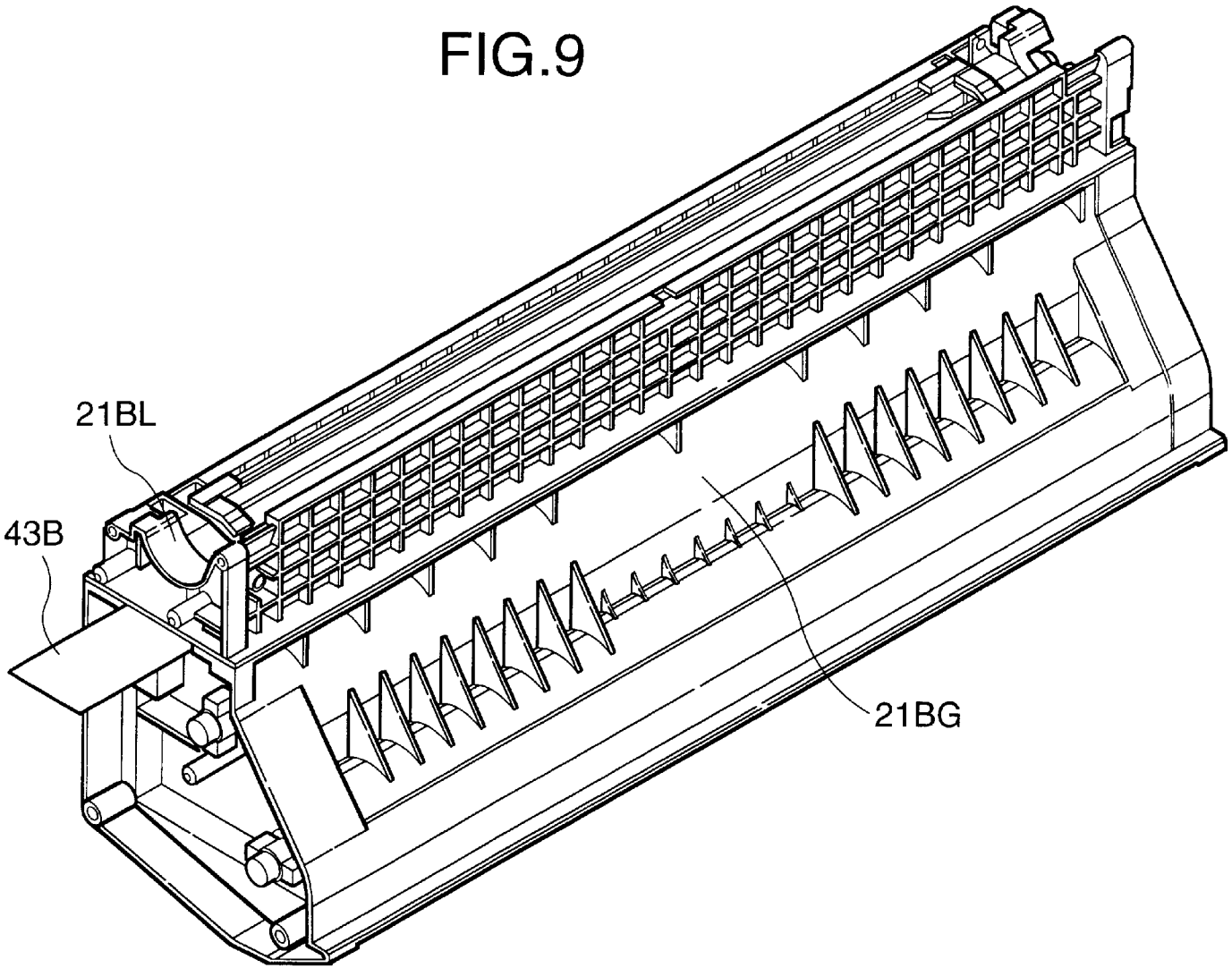
FIG. 9 is a perspective view of a portion of the black developing unit in the embodiment.

The opening seal member 43 is constructed as a toner sealing member comprising, as shown in FIGS. 7 and 8, film 43A as a first sheet member covering (sealing) the lower opening portion 21BA of the toner containing portion 21BG in a hermetically sealed state, and a tape 43B which is a flexible member as a second sheet member, the film 43A and the tape 43B being heat-welded together as a unit. The film 43A utilizes a uniaxial oriented film material or a sheet material having a tearing property in one direction. For example, use is made of uniaxial oriented polyethylene, uniaxial oriented polypropylene, uniaxial oriented foamed polypropylene or the like.

Also, the tape 43B must have sufficient strength to tear the film 43A, and should desirably have tensile strength about three times as great as the film 43A. As the material of the tape 43B, use is made, for example, of film or a sheet material of biaxial oriented polypropylene, polystyene, biaxial oriented poypropylene, polystyrene, biaxial oriented nylon or the like.

Figure 10:
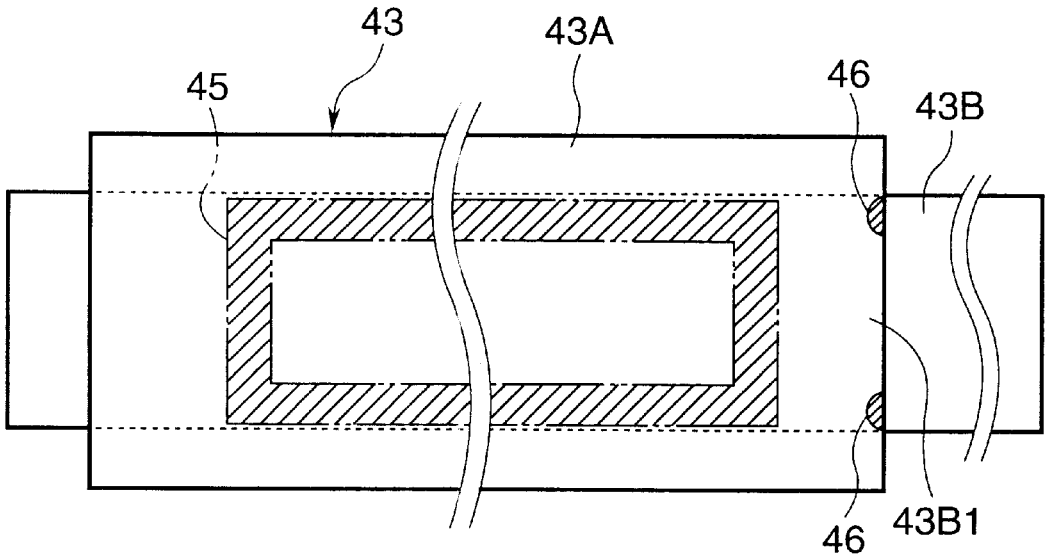
FIG. 10 is an illustration of an opening seal member in the embodiment.

The film 43A and the tape 43B, as shown in FIG. 10, are joined together by a rectangular joint portion (first joint portion) 45 of which the four sides along the lower opening portion 21BA of the toner containing portion 21BG are continuous, and the free end side of the tape 43B is turned back to the film 43A. When the turned-back free end side of the tape 43B is pulled, the film 43A is torn in a predetermined direction while keeping the width of the tape 43B.

Figure 11:
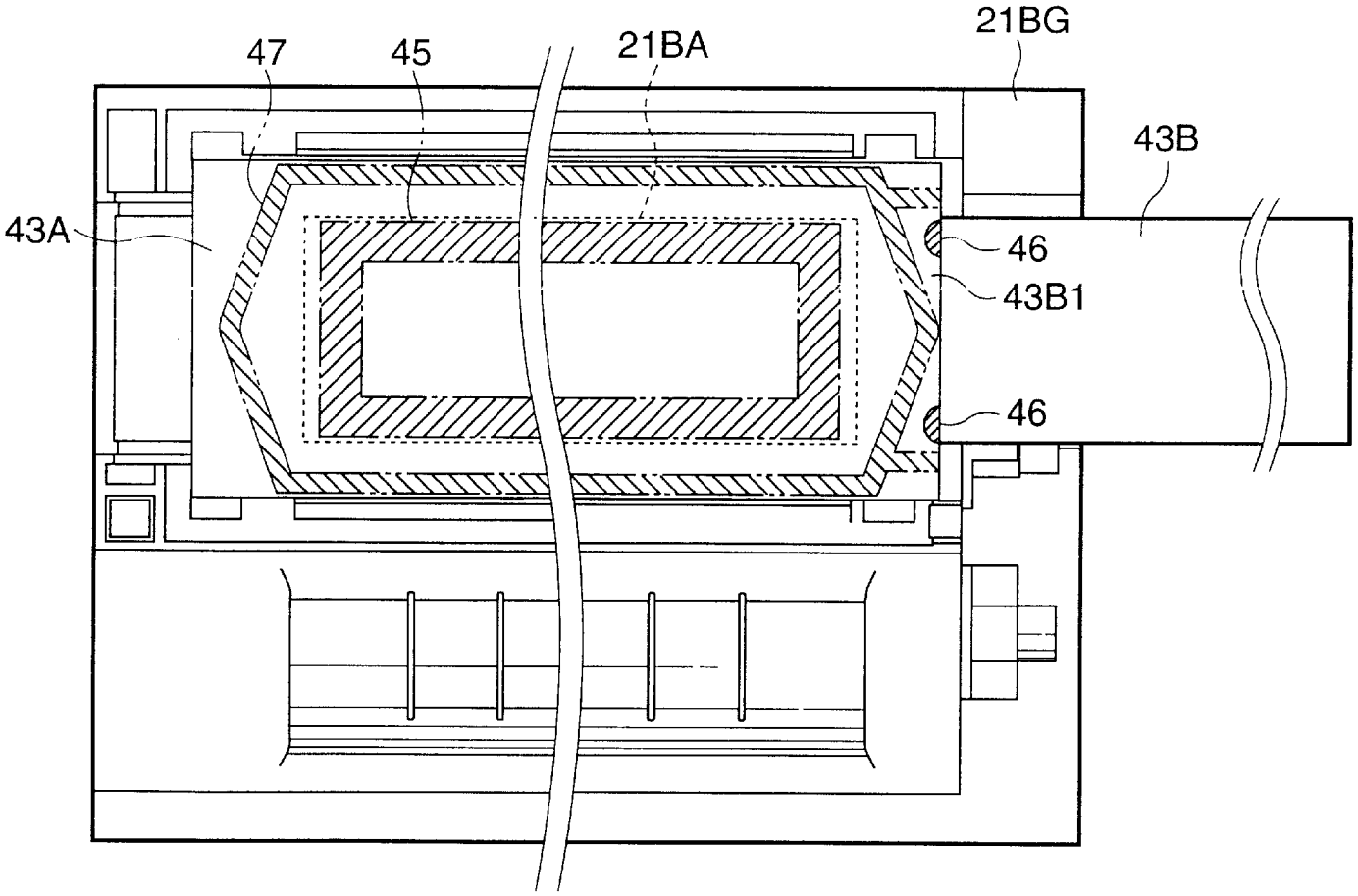
FIG. 11 is a front view of a toner containing portion provided with the opening seal member shown in FIG. 10.
Figure 24:
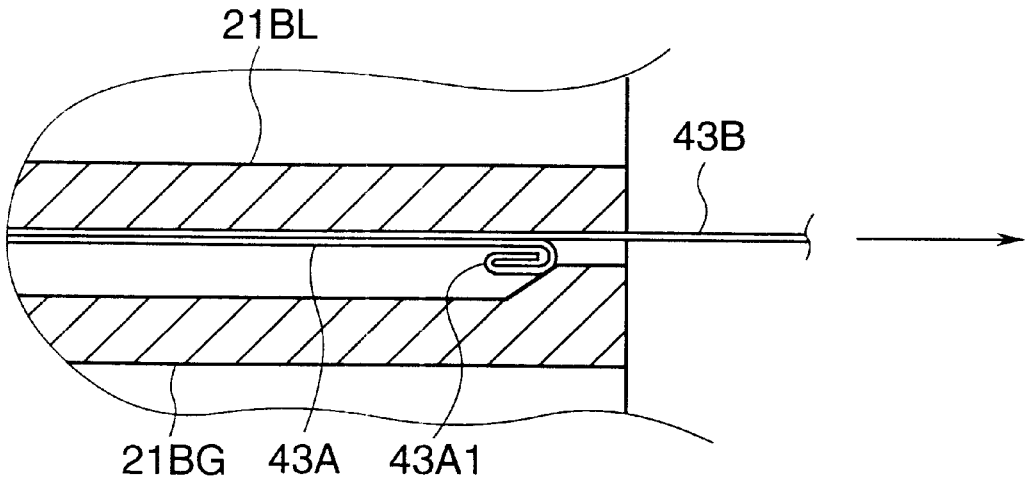
FIG. 24 is an illustration of the opening of an opening seal member according to the prior art.
Figure 25:
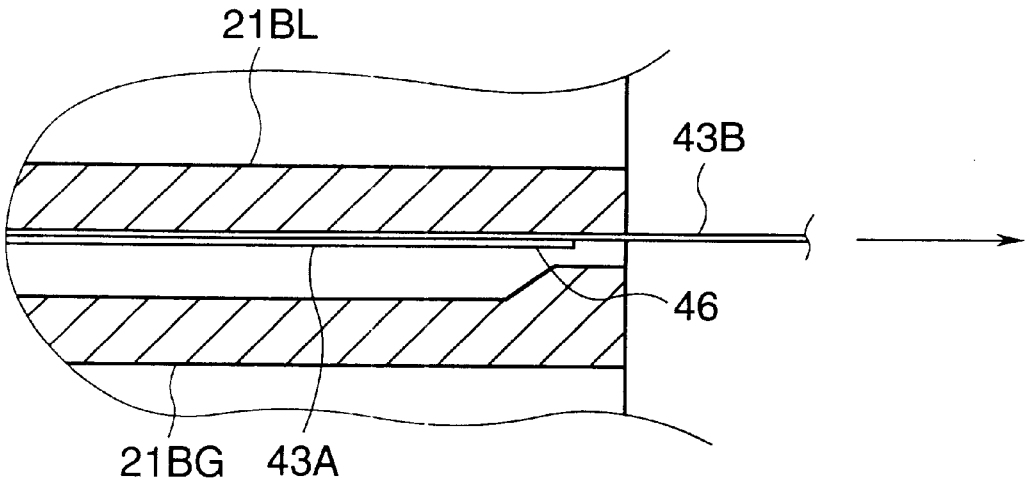
FIG. 25 is an illustration of the opening seal member in the embodiment.

In the present embodiment, besides the rectangular joint portion 45 comprising the four sides, a joint portion (second joint portion) 46 joined in a spot-like fashion to the vicinity of the turned-back portion 43B1 of the tape 43B is discontinuously provided on the film 43A and the tape 43B, as shown in FIGS. 10, 11 and 25. By this second joint portion 46, an unjoined blank portion 43A1 created near the turned-back portion 43B1 of the film 43A shown in FIG. 24 when the tape 43B is torn can be prevented from being folded doubly or trebly.

Thereby, the tape 43B can be pulled out smoothly without being caught on the way, and the lower opening portion 21BA of the toner containing portion 21BG can be stably opened.

In FIG. 11, the reference numeral 47 designates an adhesively securing area for adhesively securing the film 43A to the toner containing portion 21BG.

Now, comparing the amounts of tensile extension of the film 43A and the tape 43B with each other, the film 43A is greater in extensibility than the tape 43B. When for example, the black developing unit 21B is made to fall, the black toner inclines in the container and, by its powder pressure, the opening seal member 43 is inflated. The greater the amount of inflation, the more the fracture of the film 43A can be suppressed.

Figure 12:
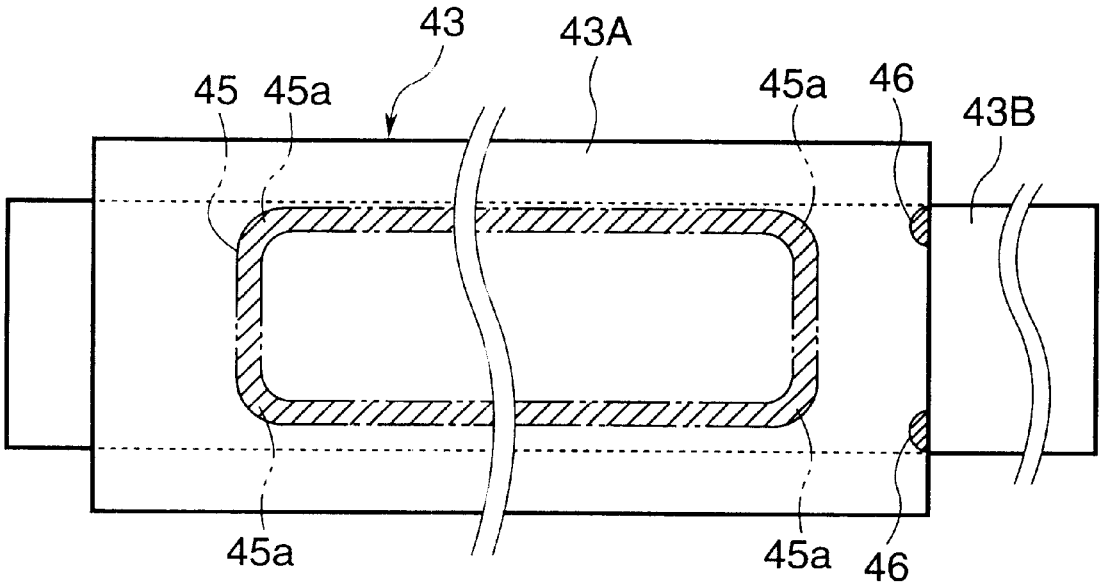
FIG. 12 is an illustration of another opening seal member in the embodiment.
Figure 13:
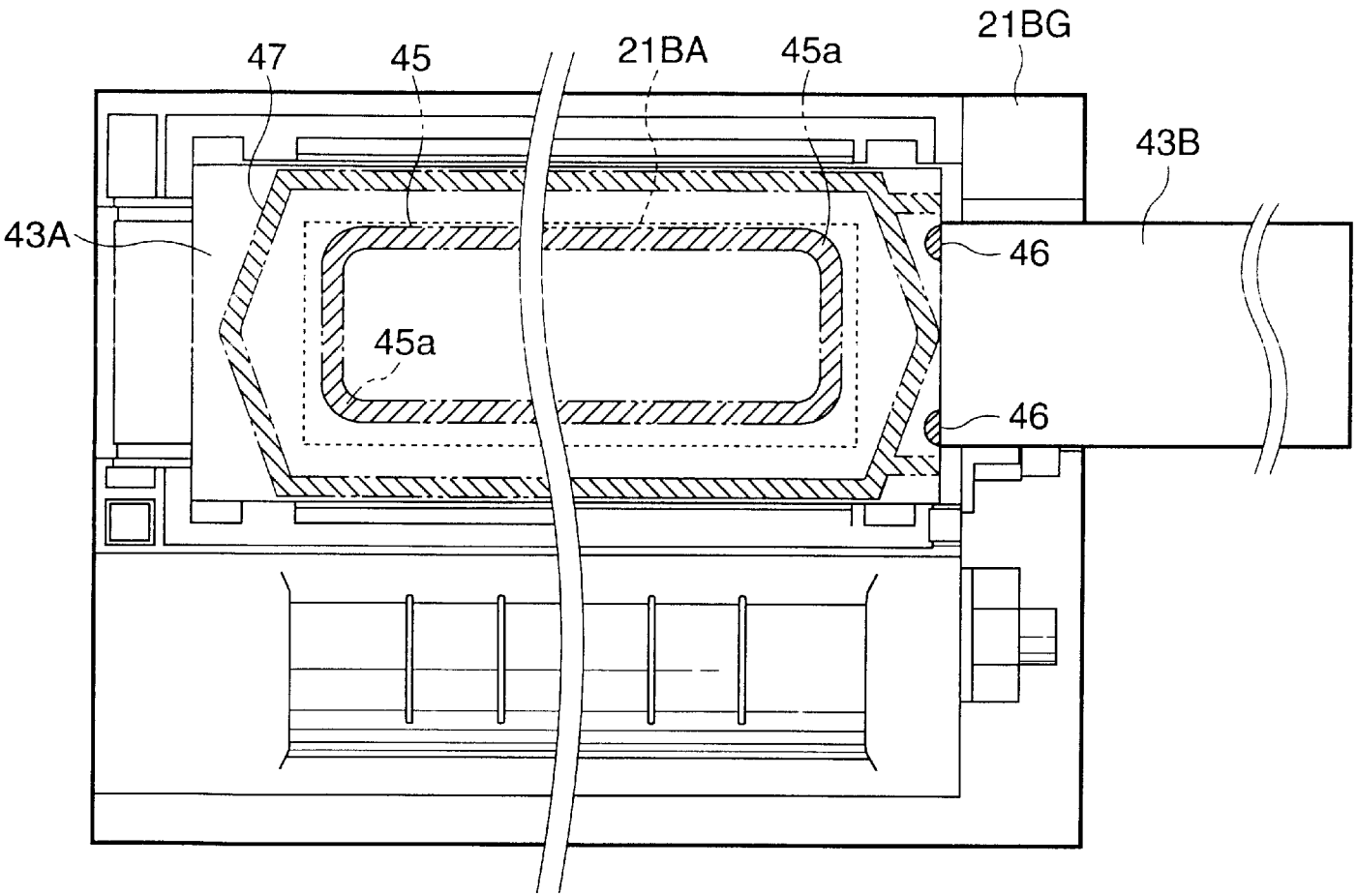
FIG. 13 is a front view of a toner containing portion provided with the opening seal member shown in FIG. 12.

In the present embodiment, as shown in FIGS. 12 and 13, the corner portion at which the adjacent two sides of the rectangular joint portion 45 intersect is formed into an arcuate joint portion 45*a*. Even if, by the shock or vibration or the like during shipment, the powder pressure of the black toner acts on the film 43A, the arcuate joint portions 45*a* become liable to be inflated in the direction in which the powder pressure of the toner acts, and the amount of stretch in the widthwise direction of the opening seal member 43 (the direction in which the two shorter sides of the joint portion 45 extend) can be increased. Thereby, the opening seal member 43 can be prevented from being fractured in the two shorter sides of the joint portion 45 by the shock or vibration during shipment.

Figure 14:
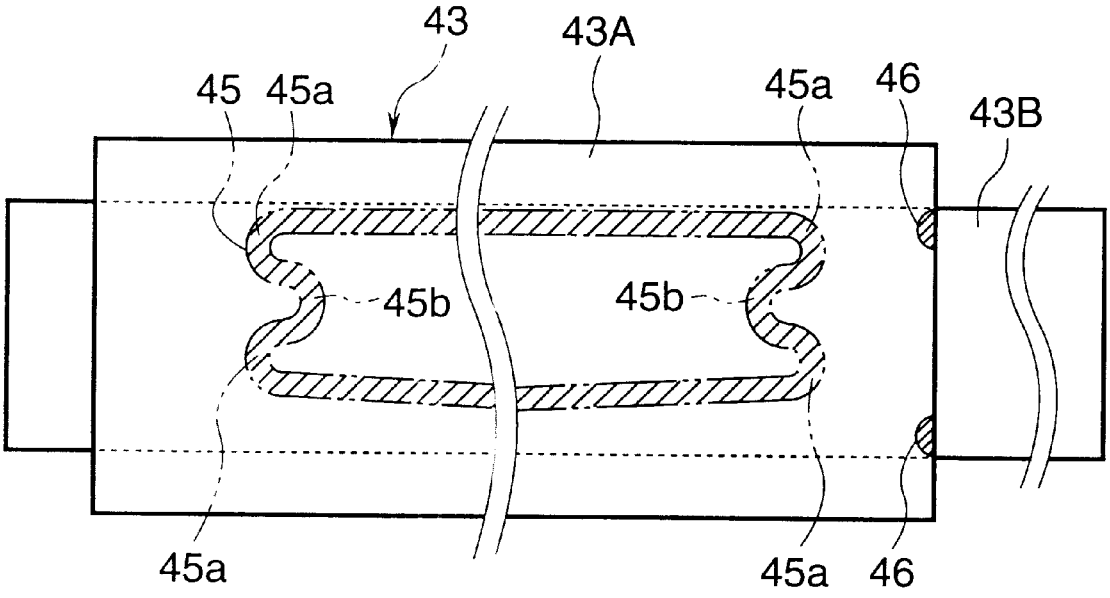
FIG. 14 is an illustration of still another opening seal member in the embodiment.
Figure 15:
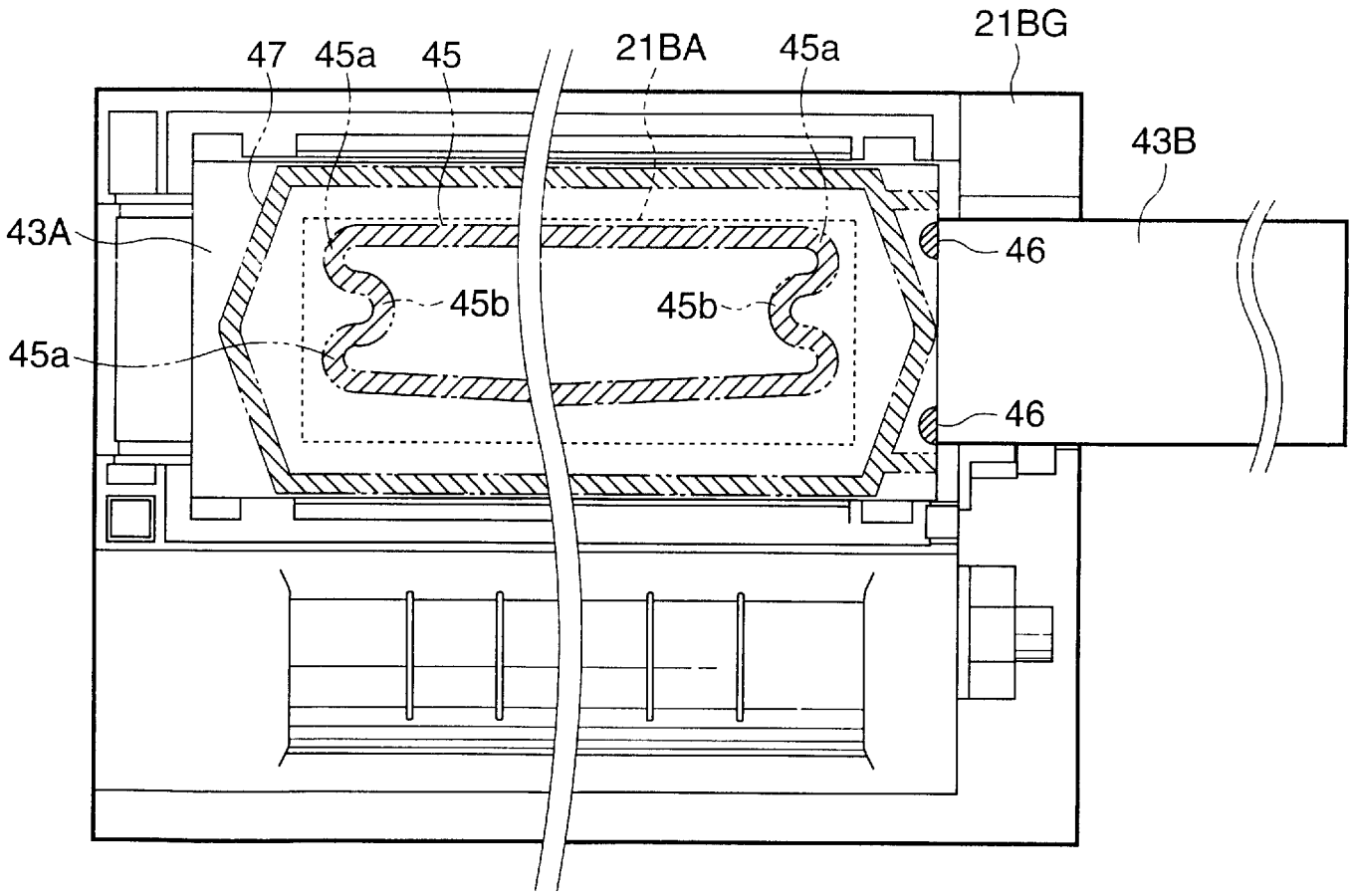
FIG. 15 is a front view of a toner containing portion provided with the opening seal member shown in FIG. 14.

Also, in this embodiment, as shown in FIGS. 14 and 15, an arc-like bent portion 45*b* is formed at each of two shorter sides of the rectangular joint portion 45. With the bent portion 45*b*, even if, by the shock or vibration or the like during shipment, the powder pressure of the black toner acts on the film 43A, each bent portion 45*b* of the two sides become liable to be inflated in the direction in which the powder pressure of the toner acts, and the amount of stretch in the widthwise direction of the opening seal member 43 (the direction in which the two shorter sides of the joint portion 45 extend) can be increased. Thereby, the opening seal member 43 can be prevented from being fractured in the two shorter sides of the joint portion 45 by the shock or vibration during shipment.

By adopting the construction as described above, a toner containing portion 21BG of a large capacity capable of containing a great deal of black toner can be provided in the black developing unit 21B.

While in the present embodiment, a bent portion 45*b* is formed at a location in each of the two shorter sides of the joint portion 45, the bent portion 45*b* may be formed at a plurality of locations.

The aforedescribed joint structure between the film 43A and tape 43B of the opening seal member 43 can also be suitably applied to the yellow developing unit 20Y, the magenta developing unit 20M and the cyan developing unit 20C.

Construction of a Toner Sealing Member (Developer Sealing Member)

The construction of a toner sealing member 40 as a developer sealing member according to the present invention will hereinafter be described.

As shown in FIGS. 19A and 19B, the toner sealing member 40 is divided into a first layer 40A as a surface layer and a second layer 40C as an inner layer. The first layer 40A is fiber having a low coefficient of friction and wear resistance, and should desirably be a synthetic fiber, such as fluorine resin fiber, polyester, acryl or nylon, a chemical fiber such as rayon, or a mixture of these.

Generally, it is desirable to use fluorine resin fiber, and use can be made, for example, of polytetrafluoroethylene (PTFE), tetrafluoroethylene-hexafluoropropylene copolymer (FPT), tetrafluoroethylene-parfluoroalkyl vinyl ether copolymer (PFA), tetrafluoroethylene copolymer (ETFE) or the like.

Figure 20:
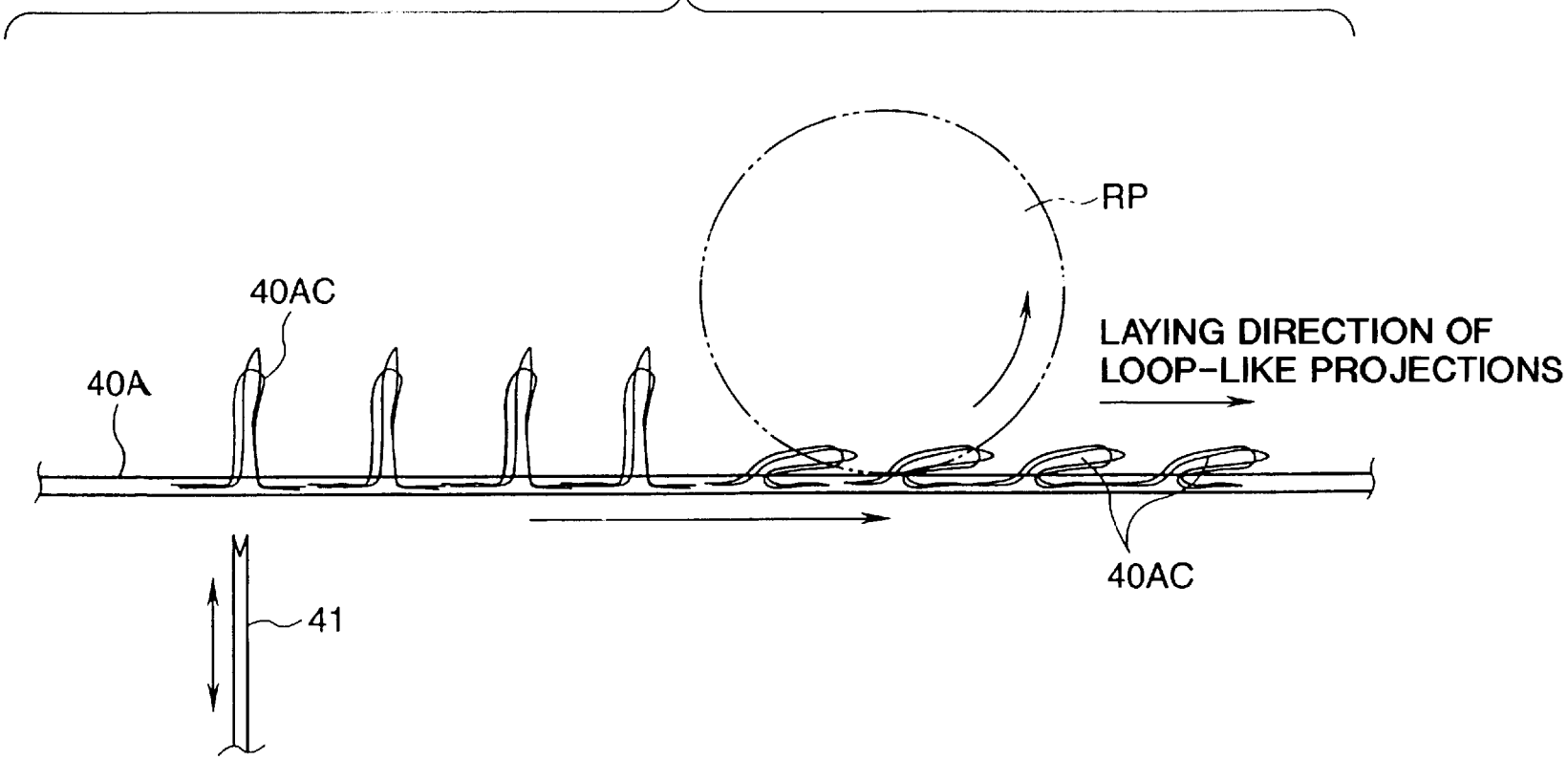
FIG. 20 is an illustration of the working of the toner sealing member in the embodiment.

In the present embodiment, fiber having PTFE mixed therewith and made into felt is used as the first layer 40A. As shown in FIG. 20, the felt has its fiber projected from the felt surface to a height of 0.5 to 5 mm by the use of a fork needle 41, and is formed with loop-like projections 40AC.

Next, the raising holding process is carried out, and by the use of roll press RP or the like, the loop-like projections 40AC is laid in a predetermined direction, i.e., the same direction as the axial direction of the developing roller 21BS to thereby make the thickness of the texture uniform. Further, the direction in which the projections 40AC of the developer sealing member 40 is laid is toward the inside of the developing roller 21BS.

Then, the first layer 40A and the polyurethane foam (e.g. Poron produced by INOAC Inc.) of the second layer 40C, which is a cushion material, are joined together by a both-surface tape 40B having no base material (e.g., No. 5619 produced by Nitto Electric Industrial Co., Ltd., F-69PC produced by Sumitomo 3M Ltd. or the like).

Further, the same both-surface tape 40D having no base material as the aforedescribed both faces (both-surface) tape 40B is adhered to the outer side of the second layer 40C (the side opposite to the first layer 40A).

The toner sealing member 40 is fixed to the developing portion frame 21BL on the outer side of the lower opening portion 21BA of the toner containing portion 21BG in a state bent along the circumferential surface (outer peripheral surface) of the lengthwise end portion of the developing roller 21BS by the both-surface tape 40D. The black toner is supplied from the opening portion 21BA to the developing roller 21BS, and the projections 40AC of the belt surface of the first layer 40A is in close contact with a portion of the circumferential surface (outer peripheral surface) of the developing roller 21BS (a portion of the outside of the area to which the black toner is applied (the outside of the black toner bearing area)).

The toner sealing member 40 fixed to the developing portion frame 21BL as described above is such that the loop-like projections 40AC of the felt surface of the first layer 40A catches the black toner on the outer peripheral surface of the developing roller 21BS and prevents the outflow of the black toner to the outside.

Also, the direction in which the loop-like raising 40AC of the first layer 40A is laid down is toward the lengthwise center of the developing roller 21BS. Therefore, the resistance in the outflow direction of the black toner can be increased and thus, the outflow of the black toner can be better prevented.

Also, the both-surface tape 40B having no base material is used for the joining of the first layer 40A and the second layer 40C and therefore, when the toner sealing member 40 is bent along the circumferential surface of the developing roller 21BS and fixed to the developing portion frame 21BL, the felt surface of the first layer 40A can be prevented from being wrinkled.

Also, the both-surface tape 40D having no base material is adhesively secured to the outer side of the second layer 40C, whereby the toner sealing member 40 can be bent so as to be along the circumferential surface of the developing roller 21BS and accurately fixed to the developing portion frame 21BL.

While in the present embodiment, the toner sealing members 40 are disposed on the lengthwisely opposite end portions of the developing roller 21BS of the black developing unit 21B, of course they may be disposed on the lengthwisely opposite end portions of each of the developing rollers 20YS, 20MS and 20CS of the yellow developing unit 20Y, the magenta developing unit 20M and the cyan developing unit 20C, respectively, or on the lengthwisely opposite end portions of the image bearing body 15 as a process cartridge. By the toner sealing members 40 of the construction as previously described being thus disposed on the lengthwisely opposite end portions of each of the developing rollers 20YS, 20MS and 20CS or the image bearing body 15, an effect similar to the effect obtained by the aforedescribed toner sealing members 40 can be obtained.

Construction of the Shutter

Now, on the black developing device 21B, as previously described, the shutter 21BO for protecting the developing roller 21BS is held so as to be rotatively movable (see FIGS. 2, 5 and 26). As shown in FIG. 26, a shutter opening-closing member 21BP is rotatably mounted on a holder 21BY disposed on the rear side of the black developing device 21B, and is biased in one direction by a spring (not shown).

Also, a shutter shaft 21BQ is disposed astride a holder 21BX disposed on the front side of the black developing device 21B, and is rotatably supported by a mounting member, not shown, provided on the same axis as the axis of the developing roller 21BS.

When in this state, a rotational moment is given to the other end portion (arm end) 21BP1 of the shutter opening-closing member 21BP in a direction perpendicular to the bus line of the image bearing body 15, the shutter opening-closing member 21BP is rotated and the shutter 21BO is smoothly rotatively moved.

In order to realize the rotation of the shutter opening-closing member 21BP, in the present embodiment, an opening-closing guide member 51 is disposed in a pivotally movable guide portion 50 provided in the main body 100 of the printer (see FIG. 2). The opening-closing guide member 51 is fixed to the pivotally movable guide portion 50 and is a wall surface formed by a gentle slope.

When the user inserts the developing unit 21B into the pivotally movable guide portion 50 to some extent, the arm end 21BP1 of the shutter opening-closing member 21BP bears against the opening-closing guide member 51. When the insertion of the black developing unit 21B is further continued, the arm end 21BP1 of the shutter opening-closing member 21BP moves along the gentle slope formed on the opening-closing guide member 51.

The shutter 21BO as the protective member in the present embodiment is formed of permanent charging preventing resin, of which the surface resistivity is $10^5$ to $10^{13}$ Ω/sq. By the shutter 21BO being formed of permanent charging preventing resin, dust, nap, etc. can be prevented from electrostatically adhering to the shutter 21BO.

As hydrophilic polymers used in permanent charging preventing resin, there are, for example, polyethylene glycol methacrylate copolymer, poly(ethyleneoxide/proyleneoxide) copolymer, polyamide of polyethylene glycol series, polyester amide of polyethylene glycol series, poly(epichlorohydrin/ethyleneoxide) copolymer, etc.

Other Embodiments

In the aforedescribed embodiment, a color toner image forming apparatus has been exemplified as the electrophotographic image forming apparatus, whereas the present invention need not be restricted thereto, but a similar construction can also be adopted in an electrophotograhic image forming apparatus such as a monochromatic electrophotographic image forming apparatus, an electrophotographic copying apparatus, an electrophotographic facsimile apparatus or an electrophotographic word processor.

Also, the electrophotographic photosensitive body is not restricted to the photosensitive drum (image bearing body), but for example, the following are included. First, a photoconductive body may be used as the photosensitive body, and for example, amorphous silicon, amorphous selenium, zinc oxide, titanium oxide and organic photoconductive material (OPC) may be included as the photoconductive body. Also, as a shape carrying the photosensitive body thereon, use may be made, for example, of a drum-like shape or a belt-like shape, and for example, in a drum type photosensitive body, a photoconductive material is deposited by evaporation or applied onto a cylinder of an aluminum alloy or the like.

Also, as the developing method, it is possible to use one of several developing methods, such as the conventional two-component magnetic brush developing method, the cascade developing method, the touchdown developing method and the cloud developing method.

Also, while in the aforedescribed embodiment, the so-called contact charging method has been used as the construction of the charging means, it is a matter of course that as other construction, use may be made of a construction in which a metallic shield of aluminum or the like is provided around a heretofore used tungsten wire, and positive or negative ions created by applying a high voltage to the tungsten wire are moved to the surface of a photosensitive drum, and the surface of this drum is uniformly charged.

As the charging means, use may be made of a blade (charging blade), a pad type one, a block type one, a rod type one, a wire type one or the like, besides the aforedescribed roller type one.

Also, as the method of removing any toner residual on the photosensitive drum, a blade, a fur brush, a magnetic brush or the like may be used to construct cleaning means.

Also, the drum unit as the aforedescribed process cartridge is provided, for example, with an electrophotographic photosensitive body and at least one process means acting on this electrophotographic photosensitive body. Accordingly, as the modes of the process cartridge, there are, besides the aforedescribed embodiment, for example, one detachably attachable to the main body of the image forming apparatus, one comprising an electrophotographic photosensitive body and cleaning means integrally made into a cartridge so as to be detachably attachable to the main body of the image forming apparatus, and further, such cartridge also provided with a developing apparatus.

What is claimed is:

1. A seal member contactable with a rotatable body for sealing a developer carried by the rotatable body, comprising:

a surface layer contactable with the rotatable body, wherein said surface layer is felt, and said surface layer has a base portion formed by a plurality of fibers, and a loop portion formed by loop-like projections of the fibers that project from the base portion toward the rotatable body.

2. A seal member according to claim 1, further comprising an inner layer on a side of the base portion opposite to a side on which the loop portion is provided, said inner layer being a cushion material.

3. A seal member according to claim 1, wherein, in the loop portion, the fibers are laid substantially in a rotary axis direction of the rotatable body.

4. A seal member according to claim 2, wherein, in the loop portion, the fibers are laid toward a central side in a lengthwise direction of the rotatable body.

5. A seal member according to claim 1, wherein the fibers that form said surface layer include fluorine resin fiber.

6. A seal member according to claim 2, wherein said inner layer includes polyurethane foam.

7. A seal member according to claim 2, wherein said surface layer and said inner layer are adhered to each other by a both faces tape having no base material.

8. A seal member according to claim 2, wherein a both faces tape having no base material is adhered to a side of said inner layer opposite to a side on which said surface layer is provided.

9. A seal member according to claim 1, wherein in the loop portion, a height to which the fibers project from the base portion is 0.5 to 5 mm.

10. A developing apparatus, comprising:

a developer bearing body bearing and carrying a developer to a developing position; and a seal member contactable with said developer bearing body for sealing the developer borne on said developer bearing body at a lengthwise end portion of said developer bearing body, wherein said seal member includes a surface layer contacted with said developer bearing body, said surface layer is felt, and said surface layer has a base portion formed by a plurality of fibers, and a loop portion formed by loop-like projections of the fibers that project from the base portion toward said developer bearing body.

11. A developing apparatus according to claim 10, wherein said seal member includes an inner layer on a side of the base portion opposite to a side on which the loop portion is provided, and said inner layer is a cushion material.

12. A developing apparatus according to claim 10, wherein in the loop portion, the fibers are laid substantially in a rotary axis direction of said developer bearing body.

13. A developing apparatus according to claim 11, wherein, in the loop portion, the fibers are laid toward a central side in a lengthwise direction of said developer bearing body.

14. A developing apparatus according to claim 10, wherein the fibers that form said surface layer include fluorine resin fiber.

15. A developing apparatus according to claim 11, wherein said inner layer includes polyurethane foam.

16. A developing apparatus according to claim 11, wherein said surface layer and said inner layer are adhered to each other by a both faces tape having no base material.

17. A developing apparatus according to claim 11, wherein a both-surface tape having no base material is adhered to a side of said inner layer opposite to a side on which said surface layer is provided.

18. A developing apparatus according to claim 10, wherein, in the loop portion, a height to which the fibers project from the base portion is 0.5 to 5 mm.

19. A developing apparatus according to claim 10, wherein said developing apparatus is provided in a cartridge detachably attachable to a main body of an image forming apparatus.

20. A developing apparatus according to claim 19, wherein said cartridge includes an image bearing body on which said developing apparatus effects a developing operation.

21. A developing apparatus according to claim 20, wherein said image bearing body includes an electrophotographic photosensitive body.

* * * * *